US008192003B2

(12) United States Patent
Ishizawa

(10) Patent No.: US 8,192,003 B2
(45) Date of Patent: Jun. 5, 2012

(54) LIQUID CONTAINER AND LIQUID CONSUMING APPARATUS

(75) Inventor: Taku Ishizawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 688 days.

(21) Appl. No.: 12/341,705

(22) Filed: Dec. 22, 2008

(65) Prior Publication Data

US 2009/0262170 A1 Oct. 22, 2009

(30) Foreign Application Priority Data

Dec. 28, 2007 (JP) ..... 2007-340814

(51) Int. Cl.
*B41J 2/175* (2006.01)

(52) U.S. Cl. ..... 347/86

(58) Field of Classification Search ..... 347/86
See application file for complete search history.

(56) References Cited

U.S. PATENT DOCUMENTS

| | | | | |
|---|---|---|---|---|
| 7,293,864 | B2 | 11/2007 | Kimura et al. | 247/86 |
| 2005/0036015 | A1 * | 2/2005 | Seino et al. | 347/86 |
| 2005/0068382 | A1 | 3/2005 | Kimura et al. | 347/85 |

FOREIGN PATENT DOCUMENTS

| | | |
|---|---|---|
| JP | 2005-059317 | 3/2005 |

* cited by examiner

*Primary Examiner* — Matthew Luu
*Assistant Examiner* — Lisa M Solomon

(57) ABSTRACT

A small-capacity liquid container capable of preventing a trouble due to a pressurized deformation of a large-capacity liquid container even when plural liquid containers having different capacity are densely arranged. A liquid container is an improvement of a small-capacity liquid container of a plurality of liquid containers selected from a container lineup at least including a large-capacity liquid container and a small-capacity liquid container having an entire length smaller than that of the large-capacity liquid container, the plurality of liquid containers each having a substantially rectangular parallelepiped shape, being mounted on a container holder of a liquid consuming apparatus in a state where pairs of largest faces thereof are adjacent to each other, and supplying a liquid with an introduction of a pressurizing fluid from the liquid consuming apparatus. The small-sized liquid container includes a liquid containing section containing the liquid, a container body accommodating the liquid containing section in a pressurizing space into which the pressurizing fluid is introduced, and an extension section formed by allowing the container body to extend toward the rear end in a mounting direction in which the liquid container is mounted on the container holder.

8 Claims, 14 Drawing Sheets

LIQUID CONTAINER AND LIQUID CONSUMING APPARATUS

TECHNICAL FIELD

The present invention relates to a liquid container very suitable for an ink cartridge or the like and a liquid consuming apparatus such as a printer using the same.

BACKGROUND ART

Representative examples of the liquid consuming apparatus ejecting liquid droplets from a liquid ejecting head include an ink jet printer having an ink jet print head for printing an image, an apparatus having a coloring material ejecting head used to manufacture a color filter of a liquid crystal display and the like, an apparatus having an electrode material (conductive paste) ejecting head used to form electrodes of an organic EL display, a field emission display (FED), and the like, an apparatus having a biological organic material ejecting head used to manufacture a bio chip, and an apparatus having a sample ejecting head as a precise pipette.

Particularly, since the ink jet printer generates relatively small noise at the time of printing and can form small dots with a high density, the ink jet printer was used in many printing operations including a color print in recent years. A so-called cartridge scheme of supplying liquids to a liquid consuming apparatus from plural liquid containers storing liquids of various colors is known as the scheme of supplying a liquid to the ink jet printer. In the cartridge scheme, the liquid containers can be easily mounted on and demounted from the liquid consuming apparatus so as to allow a user to replace the liquid containers when the liquids in the liquid containers are consumed out.

For example, as shown in FIGS. 7 and 8 of Japanese Unexamined Patent Application Publication No. 2005-59317, the plural ink cartridges mounted on the liquid consuming apparatus are arranged in parallel so that pairs of largest faces of individual containers having a substantially flat rectangular parallelepiped shape are parallel to each other. A partition wall is disposed between two adjacent ink cartridges. Accordingly, the lateral width of the liquid consuming apparatus is increased, thereby causing an increase in size of the apparatus.

In Japanese Unexamined Patent Application Publication No. 2005-59317, the ink cartridges of various colors have the same capacity. However, the amounts of consumed color ink are different when a print mode is selected from color/monochrome modes. Accordingly, there is a need for mounting ink cartridges having different capacity.

SUMMARY OF THE INVENTION

An object of the present invention is to provide a small-capacity liquid container capable of preventing a trouble due to a pressurized deformation of a large-capacity liquid container even when plural liquid containers having different capacity are densely arranged and a liquid consuming apparatus capable of reducing the size of a container holder.

Means for Solving the Problems

According to a first aspect of the invention, there is provided a small-capacity liquid container of a plurality of liquid containers selected from a container lineup at least including a large-capacity liquid container and the small-capacity liquid container having an entire length smaller than that of the large-capacity liquid container, the plurality of liquid containers each having a rectangular parallelepiped shape, being mounted on a container holder of a liquid consuming apparatus in a state where pairs of largest faces thereof are adjacent to each other, and supplying a liquid with an introduction of a pressurizing fluid from the liquid consuming apparatus, the small-sized liquid container including: a liquid containing section containing the liquid; a container body having a pressurizing space into which the pressurizing fluid is introduced; and an extension section formed by allowing the container body to extend toward a rear end in a mounting direction in which the liquid container is mounted on the container holder. Here, the extension section faces one of the pair of largest faces of the large-capacity liquid container adjacent thereto when the small-capacity liquid container is mounted on the container holder, to prevent one of the pair of largest face swelling with the introduction of the pressurizing fluid from being plastically deformed.

According to a second aspect of the invention, there is provided a liquid container comprising: an outline including: a pair of largest faces; a pair of side faces disposed between the pair of largest faces; a front end face being disposed between the pair of largest faces and having a liquid supply port and a pressurizing fluid introduction hole; and a rear end face opposed to the front end face. Here, an inner space surrounded by the outline includes a liquid containing section containing a liquid, a pressurizing space into which a pressurizing fluid is introduced, and an extension section partitioned from the liquid containing section. The liquid containing section is disposed in an area of the inner space closer to the front end face, and the extension section is disposed in an area of the inner space closer to the rear end face.

According to the first aspect of the invention, the extension section formed in the liquid container enlarges the area for restricting the pressurized swelling of the large-capacity liquid container which can be mounted adjacent thereto. The extension section prevents one of the pair of largest faces of the large-capacity liquid container swelling with the introduction of the pressurizing fluid from being plastically deformed. Accordingly, it is possible to reduce a swelled and deformed volume of the large-capacity liquid container at the time of pressurizing it or to prevent the swelling and deformation at the time of pressurizing it and to smoothly replace the small-capacity liquid container. That is, even when the large-capacity liquid container is swelled and deformed due to the pressurizing, it is possible to suppress the deformed volume of the largest faces from departing from an elastic range. Then, when the pressurizing of the liquid container is released, the largest faces return to its original state. Accordingly, when the small-capacity liquid container is demounted from the container holder, it is possible to smoothly replace the small-capacity liquid container without allowing the swelled large-capacity liquid container to block a part of its demounting route.

Each of the plural liquid containers has a substantially rectangular parallelepiped shape having a front end surface in the mounting direction, a rear end face in the mounting direction, a front face, a back face, and a pair of side faces. The front face and the back face form the pair of largest faces. Since the pressurized swelling of the pair of largest faces is most remarkable and the pairs of largest faces of the adjacent liquid containers are opposed to each other, it is important to restrict the pressurized swelling.

That is, the function of the extension section is to enlarge the area of the region (the shape of the front face or the back face in a plan view) in which the front face or the back face of the small-capacity liquid container is opposed to the front face or the back face of the large-capacity liquid container adjacent thereto.

Here, when the outlines of the containers are common regardless of the liquid capacity to be contained, the largest faces of the containers are deformed by only the gap between the adjacent containers at largest in spite of the pressurized swelling of the liquid containers, thereby hardly causing the problem with plastic deformation. That is, when the outer sizes of the small-capacity liquid container (the volume of the containers) and the large-capacity liquid container are equal to each other and only the size of the liquid containing section (the volume of the liquid containing sections) disposed therein is small, the problem with the plastic deformation hardly occurs. However, it is preferable that the small-capacity liquid container has a small outer size (small volume), in that the cost of the material or the cost of transport of the liquid container and the cost of the liquid container can be reduced. The liquid containers having different volumes are provided for this reason. In addition, when the rigidity is raised by increasing the thickness of the member forming the outline of the large-capacity liquid container or the like instead of providing the extension section like the first aspect or the second aspect of the invention at the time of providing the different-capacity liquid containers, it is possible to suppress the pressurized deformation. However, in this case, the large-capacity liquid container increases in size. Both the large-capacity liquid container and the small-capacity liquid container need be mounted on the container holder. Therefore, when the large-capacity liquid container increases in size, the increase in size of the liquid consuming apparatus is also caused. On the other hand, when the extension section is provided to the small-capacity liquid container, the size of the small-capacity liquid container including the extension section is smaller than the large-capacity liquid container and thus the liquid consuming apparatus does not increase in size.

In the first aspect of the invention, the extension section may protrude to the rear side in the mounting direction from a rear end wall in the mounting direction defining the pressurizing space. In the second aspect of the invention, it is preferable that a wall is provided in the inner for partitioning the extension section from the pressurizing space. In this case, the extension section may be a non-pressurizing space into which the pressurizing fluid is not introduced.

The extension section more increases the size of the container body in the longitudinal direction than the necessary size so as to restrict the above-mentioned deformation. When a structure pressurizing the extension section is provided, the pressurizing space is larger than the necessary size and thus the more pressurizing fluid need be supplied to the pressurizing space. Accordingly, the time taken for the pressurizing or the depressurizing, that is, the time taken from the start of the pressurizing to the start of the supply of ink or the time taken from the stop of the pressurizing to the stop of the supply of ink, is elongated. When the extension section is defined or is partitioned with a wall, it is difficult to introduce the pressurizing fluid into the extension section or the extension section is a non-pressurizing space and thus it is possible to shorten the time taken for the pressurizing or the depressurizing.

In the first aspect of the invention, a hollow portion may be formed in the extension section and the hollow portion may communicate with the pressurizing space. In the second aspect of the invention, the pressurizing fluid may be introduced into the extension section. That is, the extension section different from the above-mentioned extension section may be actively pressurized and deformed. In this case, since the extension section is swelled to the pair of largest faces of the large-capacity liquid container, it is possible to enhance the deformation restricting effect.

In the first aspect of the invention, a finger hooking portion to which a finger is hooked when the liquid container is demounted from the container holder may be formed in the extension section. In the second aspect of the invention, a finger hooking portion to which a finger is hooked when the liquid container is demounted from the container holder may be formed in the rear end face of the outline.

When the small-capacity liquid container having a small total length is mounted to or demounted from the container holder, particularly, when the small-capacity liquid container located on a deep side of the container holder is demounted from the container holder, the outline cannot be grasped and thus the finger hooking portion is convenient at the time of demounting the small-capacity liquid container.

In the first aspect of the invention, the liquid container may further include a guide groove guiding a lever member disposed in the container holder to an entrance, an exit, and a locking portion. Here, the guide groove may include: an entrance guide portion guiding the lever member disposed in the container holder from the entrance to an entrance route when the liquid container moves forward and is mounted on the container holder; an intermediate guide portion guiding the lever member passing through the entrance guide portion to a locking position when the liquid container is pushed and returned with an urging force of a slider member urging the liquid container in a direction opposite to the mounting direction; and an exit guide portion guiding the lever member to an exit route to demount the liquid container with the urging force of the slider member when the liquid container is made to move forward against the urging force of the slider member when the liquid container is demounted from the container holder. In the second aspect of the invention, the outline may include a guide groove guiding a lever member disposed in the container holder to an entrance, an exit, and a locking portion. Here, the guide groove may include: an entrance guide portion guiding the lever member disposed in the container holder from the entrance to an entrance route when the liquid container moves forward and is mounted on the container holder; an intermediate guide portion guiding the lever member passing through the entrance guide portion to a locking position when the liquid container is pushed and returned with an urging force of a slider member urging the liquid container in a direction opposite to the mounting direction; and an exit guide portion guiding the lever member to an exit route to demount the liquid container with the urging force of the slider member when the liquid container is made to move forward against the urging force of the slider member when the liquid container is demounted from the container holder.

At the time of mounting the liquid container, in cooperation of the slider member and the lever member of the container holder with the guide groove of the liquid container, it is possible to hold the liquid container in the container holder by pushing the liquid container to the deep side of the container holder and then returning the liquid container with the urging force of the slider member. At the time of demounting the liquid container, the liquid container can once be pushed into the deep side of the container holder and then the liquid container can be demounted with the urging force of the slider member.

Particularly, with the operation of the above-mentioned extension section, it is possible to prevent the deformation of the large-capacity liquid container from serving as a resistive load to the movement of the small-capacity liquid container.

Accordingly, it is possible to mount and demount the small-capacity liquid container by the sufficient use of the urging force of the slider member.

In the first aspect of the invention, the liquid container may further include a circuit board electrically connected to a terminal disposed in the container holder. In the second aspect of the invention, a circuit board electrically connected to a terminal disposed in the container holder may be provided on the outline.

In this case, with the operation of the above-mentioned extension section, it is also possible to prevent the deformation of the large-capacity liquid container from serving as a resistive load to the movement of the small-capacity liquid container. As a result, it is possible to prevent an electrical connection failure accompanied with the erroneous mounting.

In the first aspect of the invention, the container body may include a liquid detector connected to the liquid containing section to detect whether an amount of remaining liquid supplied from the liquid containing section is less or greater than a predetermined value and a contact terminal electrically connected to a terminal disposed in the container holder. In the second aspect of the invention, the liquid container may further include a liquid detector connected to the liquid containing section to detect whether an amount of remaining liquid supplied from the liquid containing section is less or greater than a predetermined value and a contact terminal electrically connected to a terminal disposed in the container holder.

The detection result of the liquid detector such as the end detection or the near end detection of the liquid can be accurately transmitted to the liquid consuming apparatus through the contact terminal.

According to the first aspect of the invention, there is provided a liquid consuming apparatus including: a liquid ejecting head ejecting a liquid; a container holder mounted with a plurality of liquid containers including the liquid container according to the first aspect; a pressurizing fluid supply mechanism introducing a pressurizing fluid into the plurality of liquid containers; and a liquid supply mechanism supplying the liquid from the plurality of liquid containers to the liquid ejecting head. Here, the container holder is mounted with the plurality of liquid containers each having a substantially rectangular parallelepiped shape in a state where pairs of largest faces thereof are adjacent to each other without disposing a partition wall between two adjacent liquid containers.

According to the second aspect of the invention, there is provided a liquid consuming apparatus including: a liquid ejecting head ejecting a liquid; a container holder mounted with a plurality of liquid containers including the liquid container according to the second aspect in a state where the largest faces of the plurality of liquid containers are adjacent to each other; a pressurizing fluid supply mechanism introducing a pressurizing fluid into the plurality of liquid containers; and a liquid supply mechanism supplying the liquid from the plurality of liquid containers to the liquid ejecting head. Here, the container holder does not have a wall partitioning two adjacent liquid containers from each other.

The liquid consuming apparatus can have the same operations and advantages as the above-mentioned liquid container. In addition, by mounting the plural liquid containers without interposing a partition wall between two adjacent liquid containers, it is possible to reduce the size of the container holder and thus to contribute to the decrease in size of the liquid consuming apparatus itself.

BEST MODE FOR CARRYING OUT THE INVENTION

Hereinafter, embodiments of the invention will be described. The embodiments to be described below are not intended to improperly restrict the details of the invention described in the claims and all elements described in the embodiments are not essential to the solving means of the invention.

Brief Description of Liquid Consuming Apparatus

Figure 1:
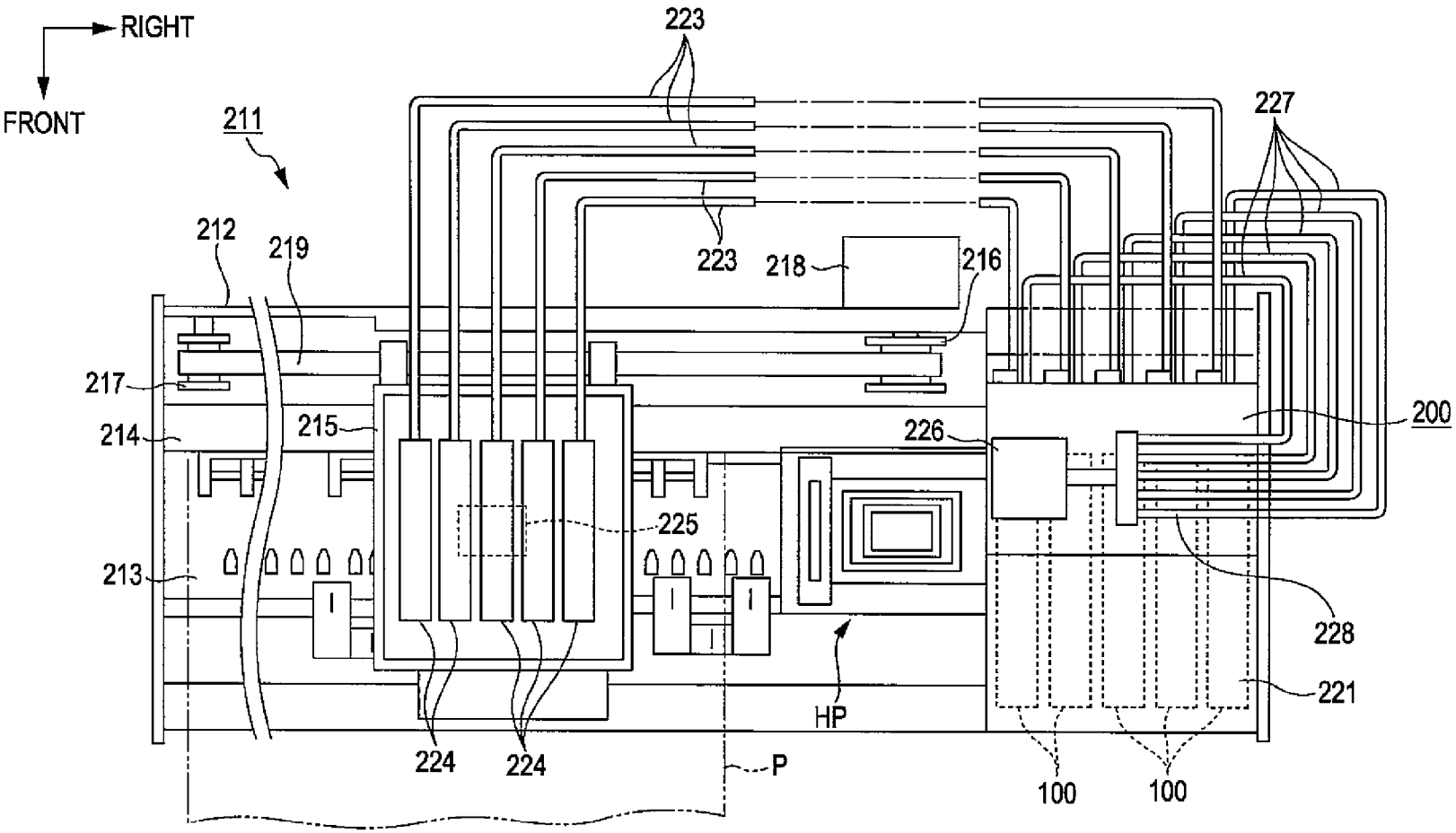
FIG. 1 is a diagram schematically illustrating a configuration of a liquid consuming apparatus according to an embodiment of the invention.

FIG. 1 is a diagram schematically illustrating a configuration of a liquid consuming apparatus according to an embodiment of the invention. An ink jet printer 211 as the liquid consuming apparatus according to this embodiment includes a main case 212 having a substantially rectangular box shape as shown in FIG. 1. At a lower portion of the front side of the main case 212, a platen 213 is provided along the longitudinal direction (the right and left directions in FIG. 1) of the main case 212 as a main scanning direction. The platen 213 is a support base supporting a printing sheet P as a target. The printing sheet P is fed onto the platen 213 in a sub scanning direction perpendicular to the main scanning direction by a sheet feed mechanism not shown.

A rod-shaped guide shaft 214 is disposed along the main scanning direction above the rear side of the platen 213 in the main case 212. A carriage 215 is supported by the guide shaft 214 so as to be movable along the guide shaft 214.

In a side surface of the rear portion of the main case 212, a driving pulley 216 and a driven pulley 217 are rotatably supported at positions corresponding to both ends of the guide shaft 214. A carriage motor 218 is connected to the driving pulley 216 and an endless timing belt 219 supporting the carriage 215 is suspended on the pair of pulleys 216 and 217. Accordingly, the carriage 215 can reciprocate in the main scanning direction along the guide shaft 214 by the driving of the carriage motor 218.

A cartridge holder (container holder) 200 as a container holder having a box shape is disposed at one end of the main case 212 (at the right end in FIG. 1). The front wall of the cartridge holder 200 and the portion corresponding to the top wall thereof form a lid portion 221 that can be opened and closed. A user can replace an ink cartridge 100 as a liquid container by opening the lid portion 221. That is, plural (five in this embodiment) ink cartridges 100 prepared for the respective colors of ink as a liquid can be mounted on and demounted from the cartridge holder 200 with the mounting and demounting operations in the front and rear directions in a state where the lid portion 221 is opened.

When mounted on the cartridge holder 200, the ink cartridges 100 are connected to the upstream ends of ink supply passages 223, respectively. The downstream ends of the ink supply passages 223 are connected to the upstream portions of valve units 224 mounted on the carriage 215. The downstream portions of the valve units 224 are connected to a print head 225 as a liquid ejecting head disposed on the lower surface of the carriage 215. The ink supply passages 223 and the valve units 224 constitute a liquid supply mechanism supplying a liquid from the ink cartridges 100 to the print head 225.

A home position HP as a retreating position of the print head 225 is disposed between the cartridge holder 200 and the platen 213. A variety of maintenance processes such as cleaning the print head 225 is performed at the home position HP before starting a printing operation or the like.

In the main case 212, a pressurizing pump 226 is disposed at a position above the cartridge holder 200. The pressurizing pump 226 serves as a supply source of pressurizing air (pressurizing fluid) and is connected to the upstream end of a pressurizing air supply passage 227. The pressurizing air supply passage 227 is branched from a distributor 228 disposed downstream of the pressurizing pump 226 as many as the number of ink cartridges 100. The downstream ends of the branched pressurizing air supply passages 227 are connected to the corresponding ink cartridges 100, respectively. The pressurizing pump 226, the pressurizing air supply passage 227, and the distributor 228 constitute a pressurizing fluid supply mechanism supplying the pressurizing fluid to the ink cartridges 100. The air is used as the pressurizing fluid in this embodiment, but gas or liquid other than the air may be used.

Container Holder

Figure 2:
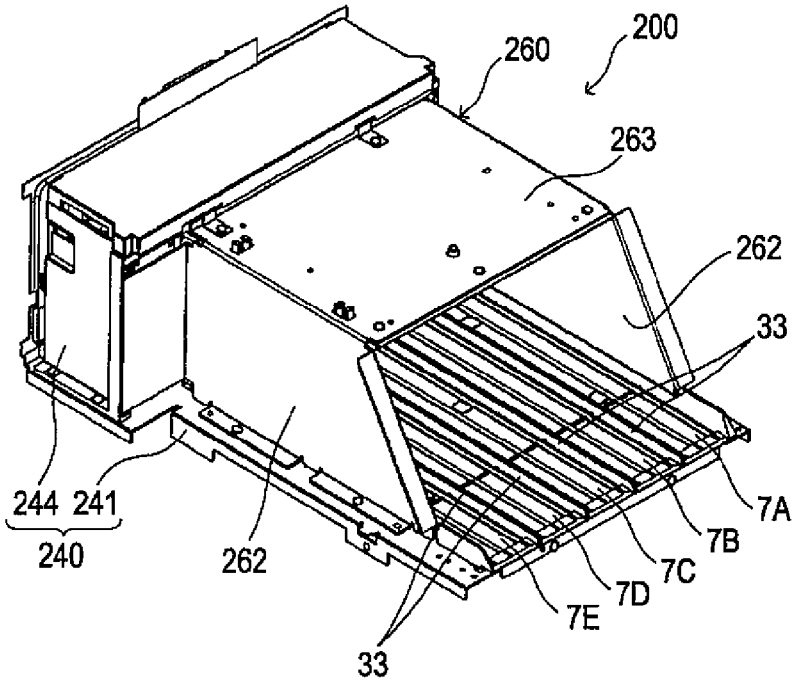
FIG. 2 is a perspective view illustrating a container holder shown in FIG. 1 as viewed from a tilted upside.
Figure 3:
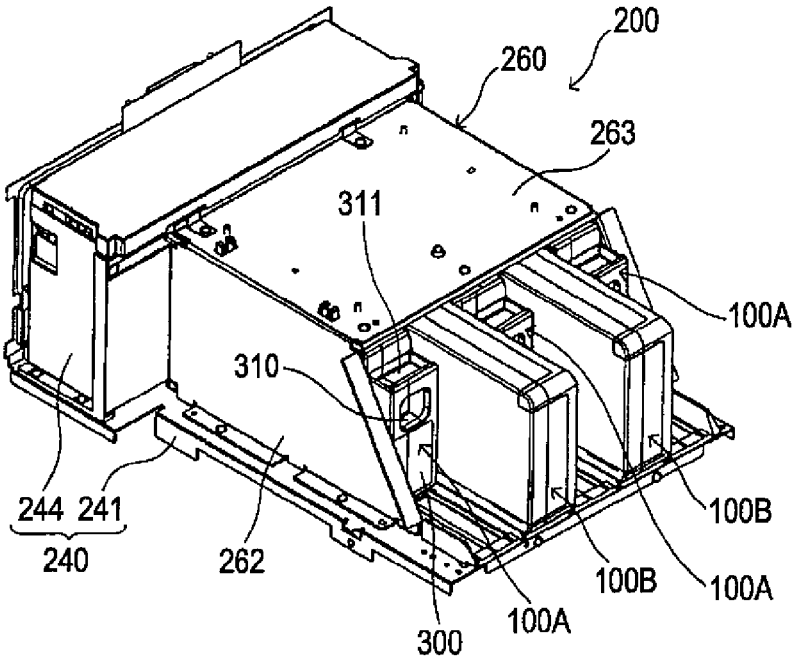
FIG. 3 is a perspective view illustrating a state where liquid containers are mounted on the container holder shown in FIG. 2.
Figure 4:
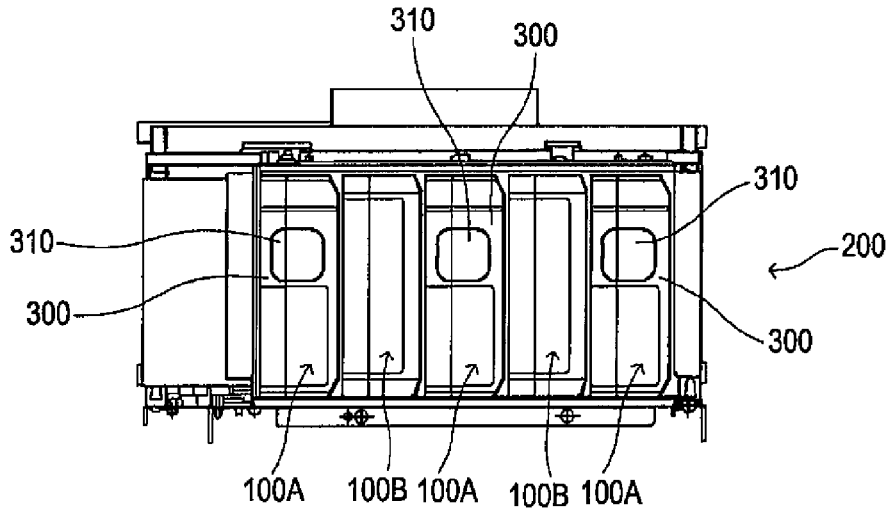
FIG. 4 is a front view illustrating the container holder shown in FIG. 3.
Figure 5:
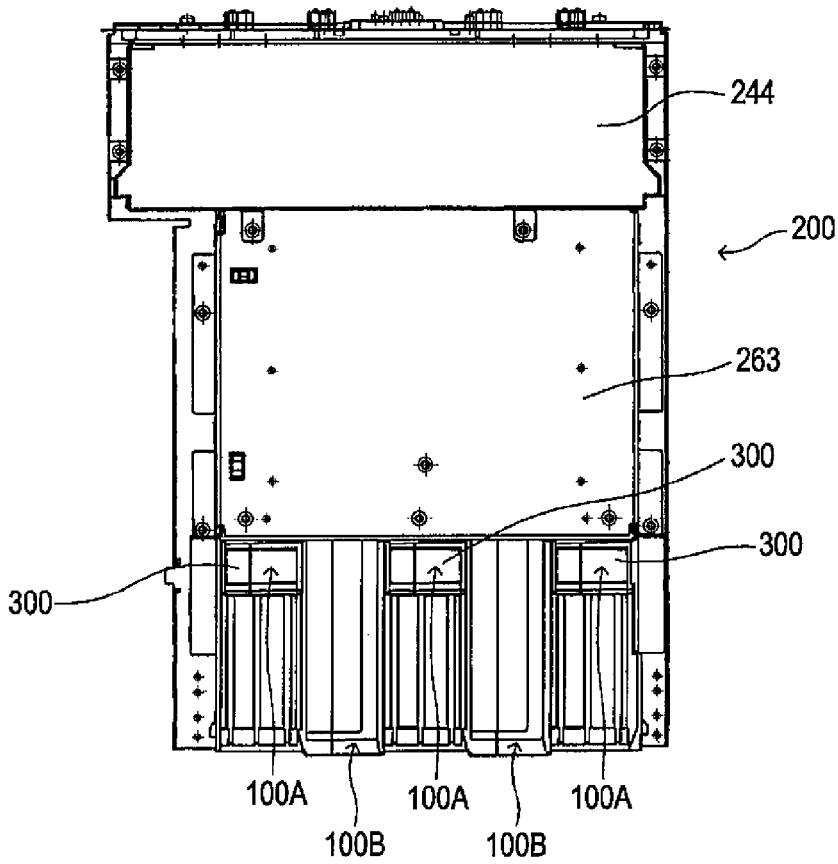
FIG. 5 is a top view illustrating the container holder shown in FIG. 3.

FIG. 2 is a perspective view illustrating a container holder as viewed from a tilted upside. FIG. 3 is a perspective view illustrating a state where liquid containers are mounted on the container holder shown in FIG. 2. FIG. 4 is a front view illustrating the container holder shown in FIG. 3. FIG. 5 is a top view illustrating the container holder shown in FIG. 3.

As shown in FIGS. 2 and 3, the cartridge holder 200 includes a holder body 240 having a substantially L shape in a side view and a frame body 260 having a c-shaped section. The frame body 260 includes a pair of supporting side walls 262 and 262 and a top wall 263 connecting the upper edges of the supporting side walls 262 and 262. The frame body 260 is formed by monolithically pressing a metal plate.

As shown in FIGS. 2 and 3, the holder body 240 includes a substrate 241 formed in a rectangular shape in a plan view out of a resin material or a metal material and an attachment body 244 attached onto the rear top surface of the substrate 241.

When the ink cartridges 100 are mounted on the cartridge holder 200, the substrate 241 serves as a support base supporting the ink cartridges 100 arranged in parallel. As shown in FIG. 2, plural guide rails 33 as first guide protrusions are arranged on the substrate 241 to extend in the front and rear directions. The guide rails 33 serve to guide the ink cartridges 100 when the ink cartridges 100 are mounted on and demounted from the cartridge holder 200. The inside of the cartridge holder 200 is partitioned into five cartridge slots 7A, 7B, 7C, 7D, and 7E by the guide rails 33. The cartridge slots 7A to 7E serve as container mounting portions receiving the ink cartridges 100 corresponding to the colors, respectively.

As shown in FIGS. 3 to 5, in this embodiment, plural, for example, five, ink cartridges are selected from a container lineup including at least a small-capacity ink cartridge 100A and a large-capacity ink cartridge 100B and are mounted on the ink cartridge holder 200 in a state where they are adjacent to each other. In the example shown in FIGS. 3 to 5, two large-capacity ink cartridges 100B are mounted between three small-capacity ink cartridges 100A, but the invention is not limited to the example.

The five ink cartridges are ink cartridges corresponding to five colors (for example, black, light black, cyan, magenta, and yellow) used in this embodiment, respectively. For example, ten kinds of container lineup in total can be prepared which includes the small-capacity ink cartridge 100A and the large-capacity ink cartridge 100B for each color. Depending on a user's usage, the large-capacity ink cartridges 100B can be selected as the ink cartridges of colors much consumed and the small-capacity ink cartridges 100A can be otherwise selected. In the following description, the ink cartridges 100A and 100B may be also referred to as the "ink cartridges 100."

The detailed configuration of the ink cartridges 100 will be described later.

Figure 6:
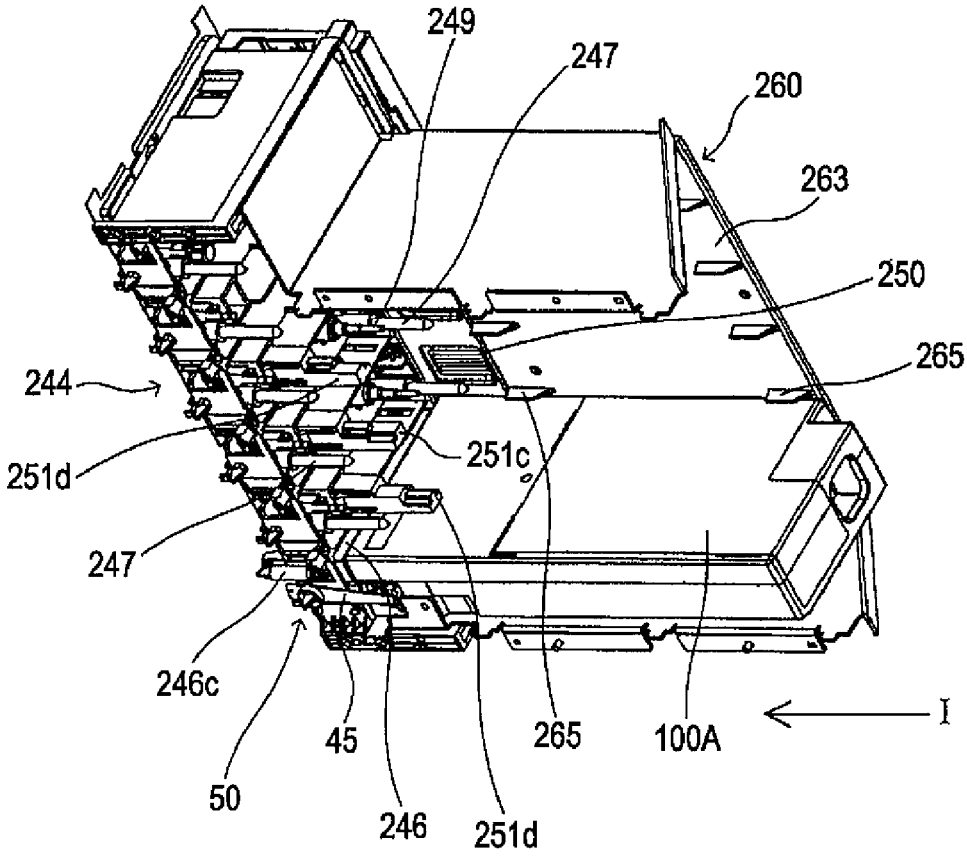
FIG. 6 is a perspective view schematically illustrating the container holder in a state where a bottom plate is detached therefrom.
Figure 7:
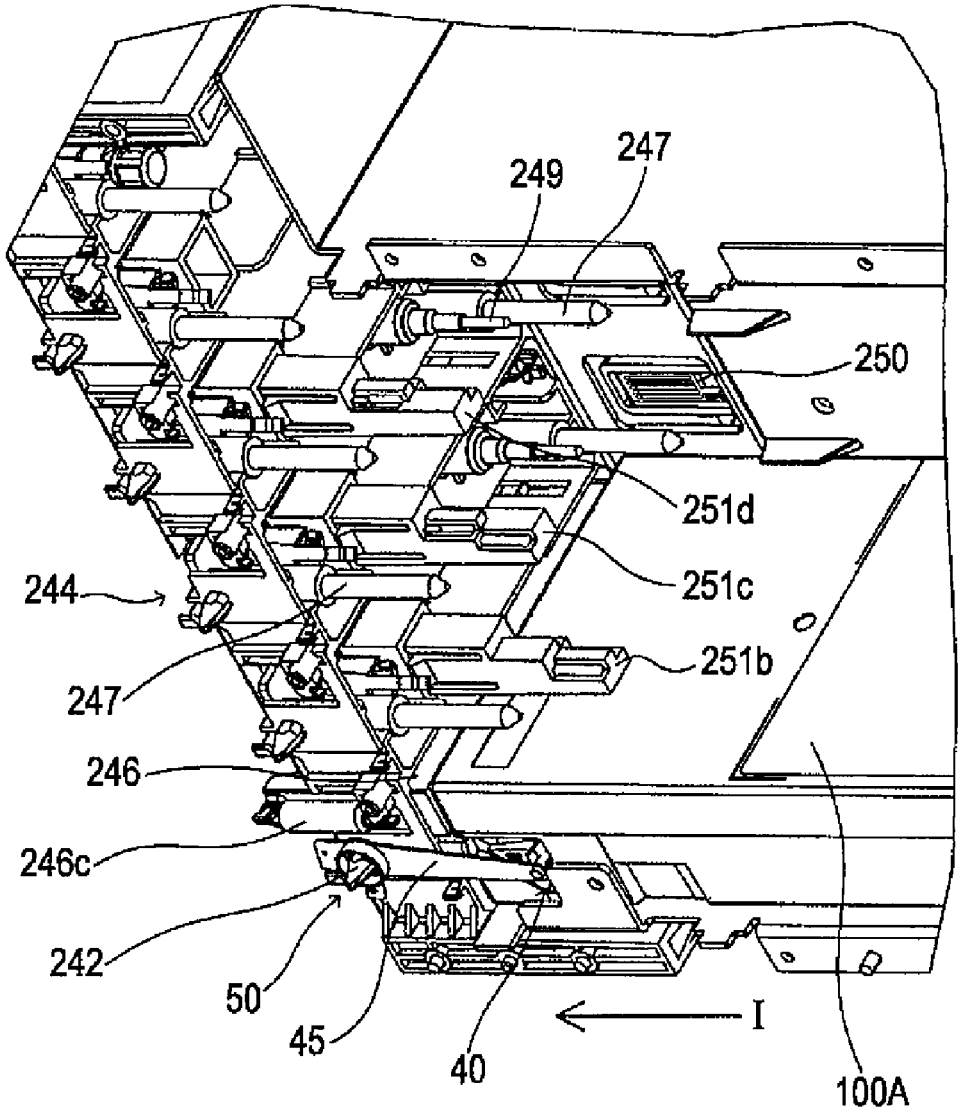
FIG. 7 is a partially enlarged view of FIG. 6.
Figure 8:
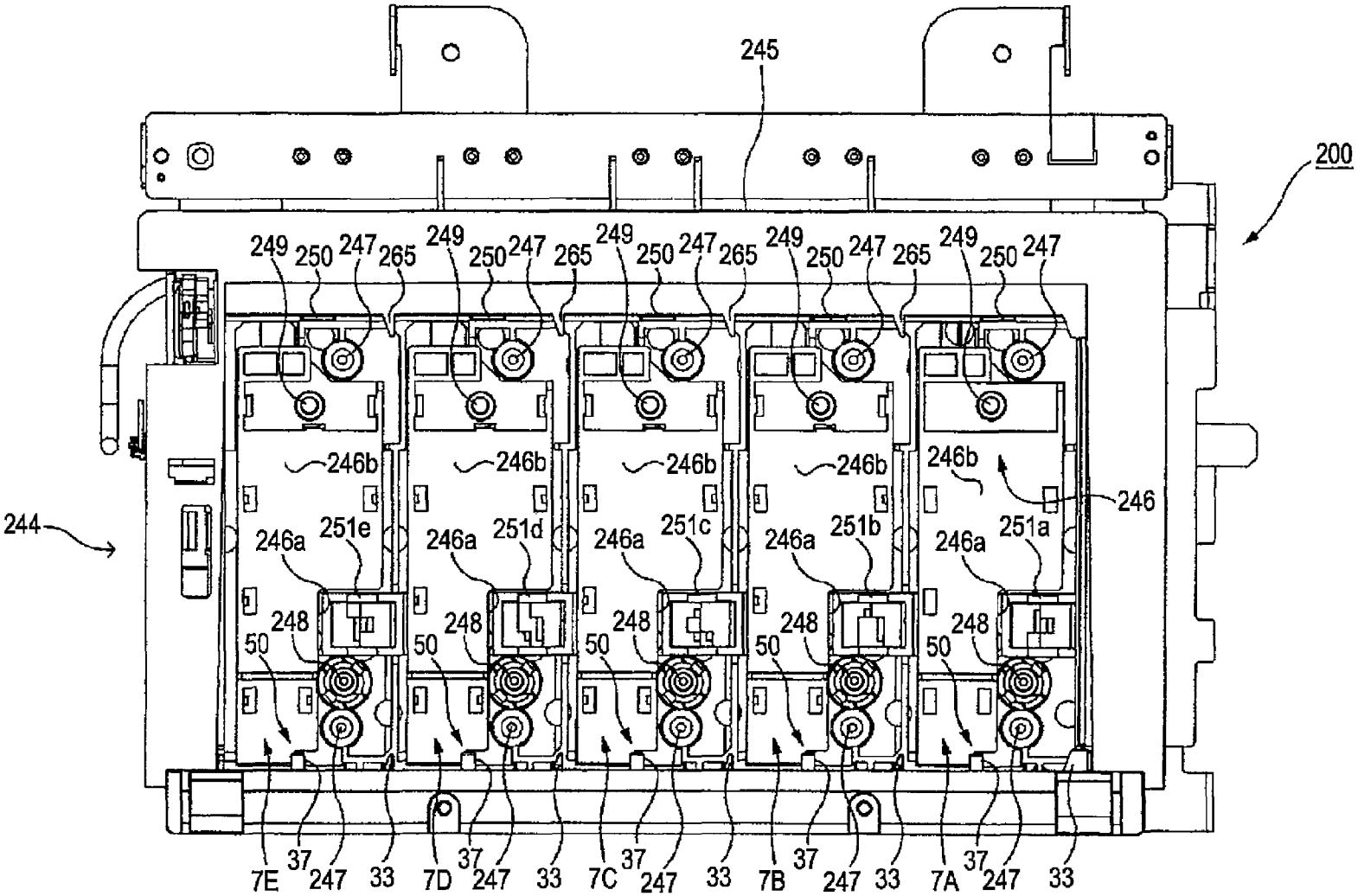
FIG. 8 is a front view illustrating the container holder.

FIG. 6 is a perspective view schematically illustrating the container holder 200 in a state where the substrate 241 on the bottom is detached therefrom. FIG. 7 is a partially enlarged view of FIG. 6. FIG. 8 is a front view illustrating the container holder 200. Some components are omitted in FIGS. 6 and 7.

In FIGS. 7 and 8, the attachment body 244 includes a slider member 246 having a surface 246*b* perpendicular to the insertion direction of the ink cartridges 100. The slider member 246 is urged in a direction (in the front direction) opposite to the insertion direction I of the ink cartridges 100 by an urging unit shown in FIGS. 6 and 7, for example, a spring 246*c*. The surface 246*b* of the slider member 246 forms deep end surfaces of the cartridge slots 7A to 7E. When the ink cartridges 100 are not mounted on the cartridge slots 7A to 7E, the slider member 246 is located at a front position in the insertion direction I with the urging force of the spring 246*c*. However, in FIGS. 6 and 7, the spring 246*c* and the slider member 246 are omitted in the cartridge slots 7B to 7E not mounted with the ink cartridges 100. FIGS. 6 and 7 show a state where one ink cartridge 100A is mounted on the cartridge slot 7A. As shown in FIG. 7, by mounting the ink cartridge 100A, the corresponding slider member 246 is extruded in a direction (in the rear direction) opposite to the insertion direction I with the urging force of the spring 246*c*.

When the ink cartridges 100 are completely mounted on the cartridge slots 7A to 7E, the slider member 246 is stopped at a predetermined position. The slider member 246 always gives the urging force in the direction opposite to the insertion direction I to the mounted ink cartridge 100 by the use of the spring 246*c*, even when the ink cartridges 100 are mounted on the cartridge slots 7A to 7E. The urging force serves to extrude the ink cartridges to the front side when the ink cartridges 100 are demounted from the cartridge slots 7A to 7E.

As shown in FIGS. 6 to 8 and as mainly shown in FIG. 8, the slider member 246 has an opening 246*a* exposing a pair of positioning pins 247 and 247, an air communication hole 248, an ink supply pin 249, and identification members 251*a* to 251*e* disposed on the rear surface of the attachment body 244 from the rear surface of the attachment body 244 to the front side.

On the rear surface of the attachment body 244, that is, on the deep end surfaces of the cartridge slots 7A to 7E, the pairs of positioning pins 247 and 247, the air communication holes 248, the ink supply pins 249, and the identification members 251*a* to 251*e* protrude to the front side through the openings 246*a* of the slider member 246.

The pairs of positioning pins 247 and 247, the air communication holes 248, the ink supply pins 249, and the identification members 251*a* to 251*e* all operate when the ink cartridges 100 are mounted on the cartridge slots 7A, 7B, 7C, 7D, and 7E on the substrate 241 on the front surface of the slider member 246 as the deep end surface of the container mounting portions 1.

The pair of positioning pins 247 and 247 serves to position the corresponding ink cartridge 100. The pairs of positioning pins 247 and 247 are disposed in the upper and lower portions of the deep end surfaces of the cartridge slots 7A to 7E, respectively.

The air communication holes 248 serve to supply air to the ink cartridges 100. The air communication holes 248 are disposed in the lower portion of the deep end surfaces of the cartridge slots 7A to 7E, respectively. The air communication hole 248 is located at a position interposed between the pair of positioning pins 247 and 247 and close to the lower positioning pin 247.

The ink supply pins 249 serve to supply ink from the ink cartridges 100 to the print head 225 (see FIG. 1) through the ink supply passages 223 (see FIG. 1). The ink supply pins 249 are disposed in the upper portions of the deep end surfaces of the cartridge slots 7A to 7E. Each ink supply pin 249 is located at a position not interposed between the pair of positioning pins 247 and close to the upper positioning pin in the vertical direction.

The identification members 251*a* to 251*e* serve to prevent the erroneous mounting of the ink cartridges 100. The identification members 251*a* to 251*e* are disposed in the lower portion of the deep end surfaces of the cartridge slots 7A to 7E, respectively. Each of the identification members 251*a* to 251*e* is located at a position interposed between the pair of positioning pins 247 and 247 and just above the air communication hole 248. That is, each of the identification members 251*a* to 251*e* is located at a position interposed between the upper positioning pin 247 and the air communication hole 248 and close to the air communication hole 248.

At the positions just above the air communication holes 248, the front ends of the plural (five in this embodiment) identification members 251*a*, 251*b*, 251*c*, 251*d*, and 251*e* protrude to the front side through cut portions 246*a* formed by cutting the slider member 246 from the downside.

The identification members 251*a* to 251*e* are hollow cylindrical members of which the rear end face as a base end extends in the front and rear directions. As shown in FIGS. 6 and 7, different convex-concave engaging portions are formed at the front ends of the identification members 251*a* to 251*e*, respectively. On the other hand, identification portions 22 (see FIG. 11) corresponding to the convex-concave shapes of the identification members 251*a* to 251*e* are formed at the front ends in the insertion direction of the ink cartridges 100. Although details thereof are not shown, the shapes of the identification portions 22 are different from each other depending on the types of the ink cartridges 100 (the kinds of ink colors).

The convex-concave engaging portions of the identification members 251*a* to 251*e* have shapes that can engage with only the identification portions 22 of the ink cartridges 100 of the corresponding colors, respectively, and cannot engage with the identification portions 22 of the ink cartridges 100 of the non-corresponding colors. In this way, in the ink jet printer according to this embodiment, by the combination of the convex-concave portions of the identification members 251*a* to 251*e* with the identification portions 22 of the ink cartridges, it is possible to prevent the erroneous mounting of the ink cartridges 100.

As shown in FIG. 8, on the top wall 263 of the frame body 260, guide protrusions 265 having a triangular section as second guide protrusions are formed at two positions in the insertion direction of the ink cartridges 100. The second guide protrusions 265 serve to guide the ink cartridges 100 when the ink cartridges 100 are mounted on and demounted from the cartridge slots 7A to 7E of the holder 200, similarly to the guide rails 33.

As shown in FIG. 8, apparatus terminals 250 are disposed on the top plate 245 of the attachment body 244. When the ink cartridges 100 are mounted on the cartridge slots 7A to 7E, the apparatus terminals 250 come in contact with contacts 17*a* (see FIG. 9) of electrodes of circuit boards 17 (see FIG. 9) disposed in the cartridges 100 and are electrically connected to the electrodes, respectively.

Figure 9:
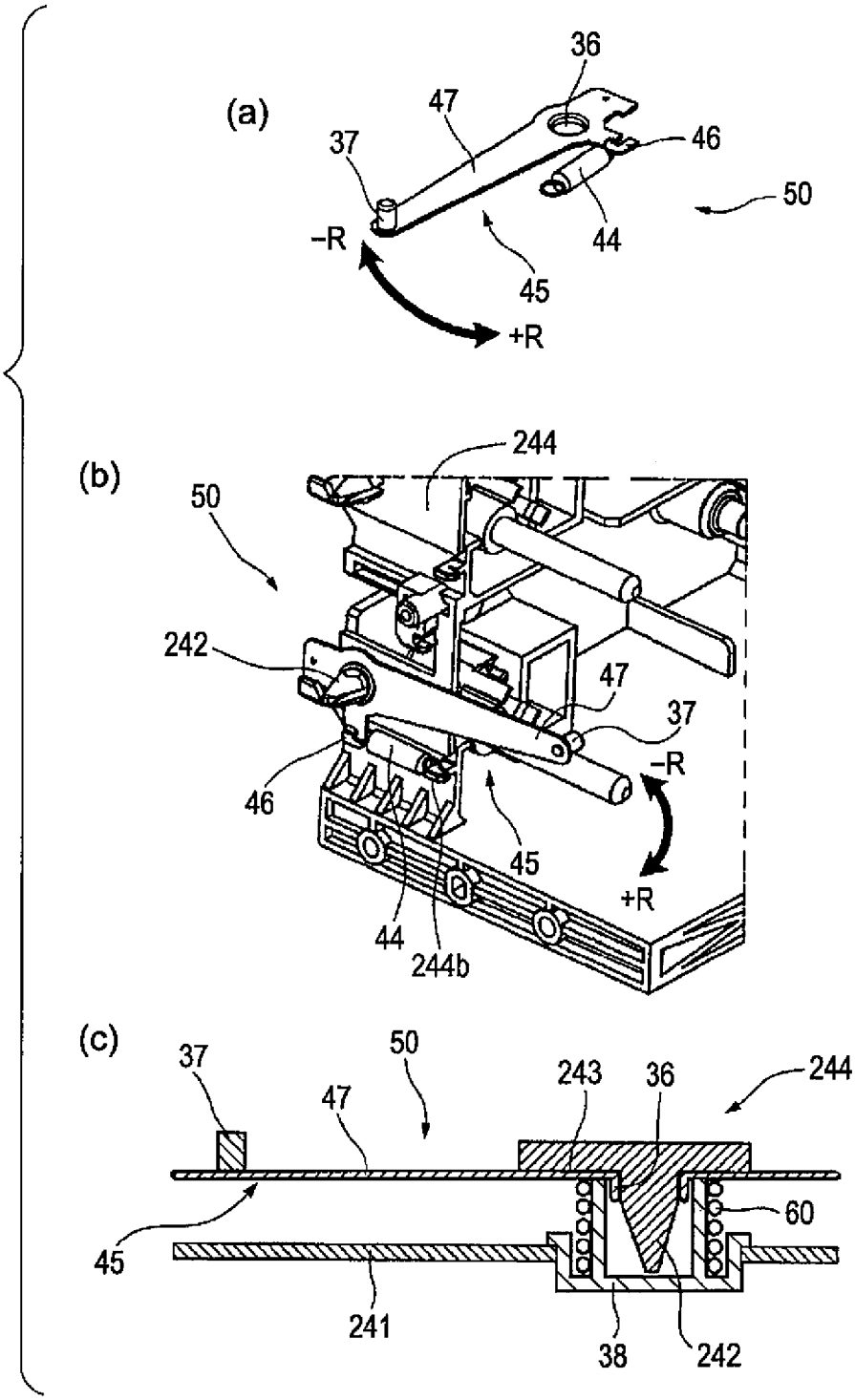
FIG. 9(*a*) is a perspective view illustrating a lever member and a spring as viewed from a cartridge, FIG. 9(*b*) is a perspective view illustrating an apparatus fixing structure as viewed from the opposite side of the cartridge, and FIG. 9(*c*) is a sectional view illustrating a vicinity of the apparatus fixing structure.

As shown in FIGS. 6 and 7, an apparatus fixing structure 50 is disposed below and inside (on the rear side) the respective cartridge slots 7A to 7E. FIG. 9(*a*) is a perspective view illustrating a lever member 45 and a spring 44 constituting the apparatus fixing structure 50 as viewed from the cartridge 100. FIG. 9(*b*) is a perspective view illustrating the apparatus fixing structure 50 as viewed from the opposite side of the cartridge 100. FIG. 9(*c*) is a sectional view illustrating the vicinity of the apparatus fixing structure 50.

As shown in FIG. 9(*c*), the apparatus fixing structure 50 includes a lever member 45 extending substantially parallel to the substrate 241. The lever member 45 includes a longitudinal and thin lever body 47 having elasticity, a shaft hole 36 disposed at a base end of the lever member 47, and a substantially cylindrical locking pin 37 (locking member) protruding from the upper surface (surface facing the cartridge 100) of the front end of the lever member 47. A gap is disposed between the bottom surface 243 of the attachment body 244 and the substrate 241 and the lever member 45 is arranged using the gap.

Protruding portions 242 are disposed on the bottom surface 243 of the attachment body 244. The protruding portions 242 are inserted into the shaft holes 36 of the lever members 45, respectively. The lever members 45 are axial supported to be rotatable about the protruding portions 242, respectively.

That is, each protruding portion 242 serves as a rotation shaft of the corresponding lever member 45. The periphery of the protruding portion 242 is held by a cap 38 and a coil spring 60 received in a groove of the cap. The spring 60 has a function of supporting the corresponding lever member 45 so as to be rotatable relative to the substrate 24' and a function of stabilizing the movement of the lever member 45 by urging the lever member 45 upward.

As shown in FIGS. 9(*a*) and 9(*b*), the apparatus fixing structure 50 includes a spring 44 giving an urging force in the rotation direction (−R direction) to the lever member 47. One end of the spring 44 is locked to a locking portion 46 disposed at a position deviated in a direction different from the direction directed to the locking pin 37 from the position of the shaft hole 36 of the lever member 47. The other end of the spring 44 is locked to a locking portion 244*b* disposed on the bottom surface of the attachment body 244. When a force against the urging force of the spring 44 is applied to the lever member 45, the lever member 45 rotates in the direction of arrow +R in FIGS. 9(*a*) and 9(*b*).

Common Configuration of Ink Cartridges

Figure 10:
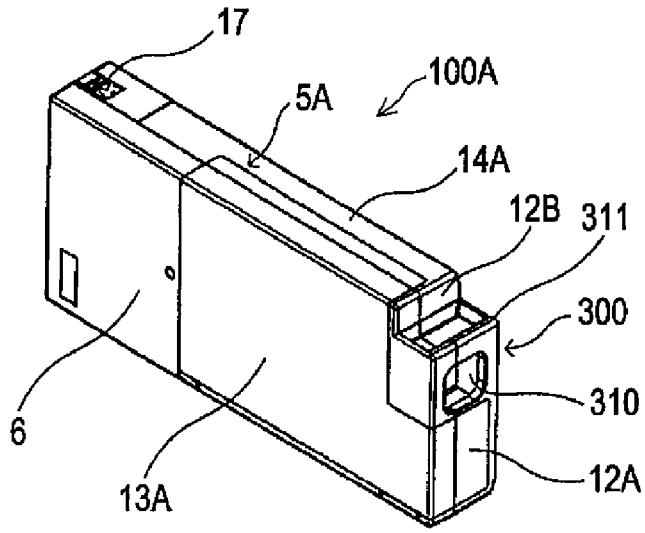
FIG. 10 is a perspective view illustrating a small-capacity ink cartridge as viewed from one side.
Figure 11:
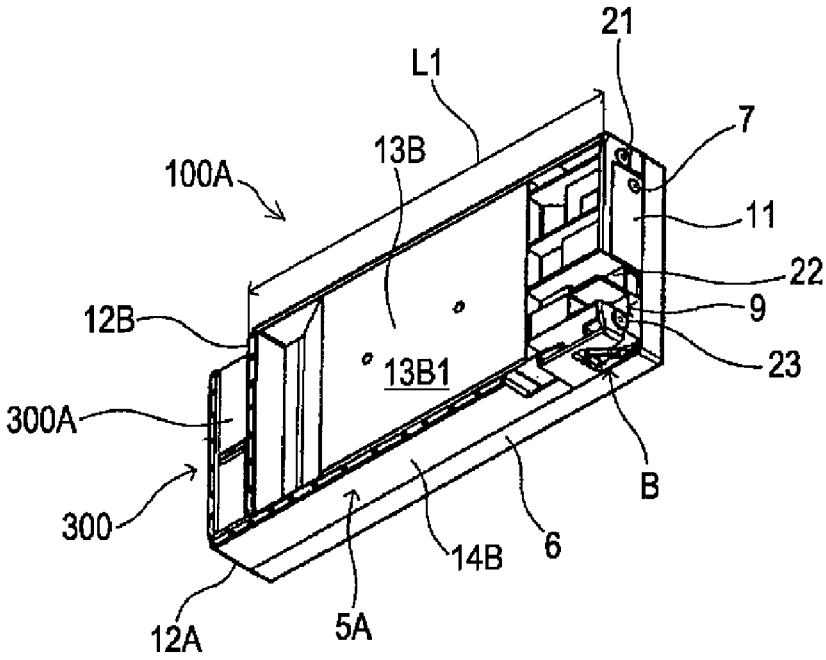
FIG. 11 is a perspective view illustrating the small-capacity ink cartridge shown in FIG. 10 as viewed from the other side.
Figure 12:
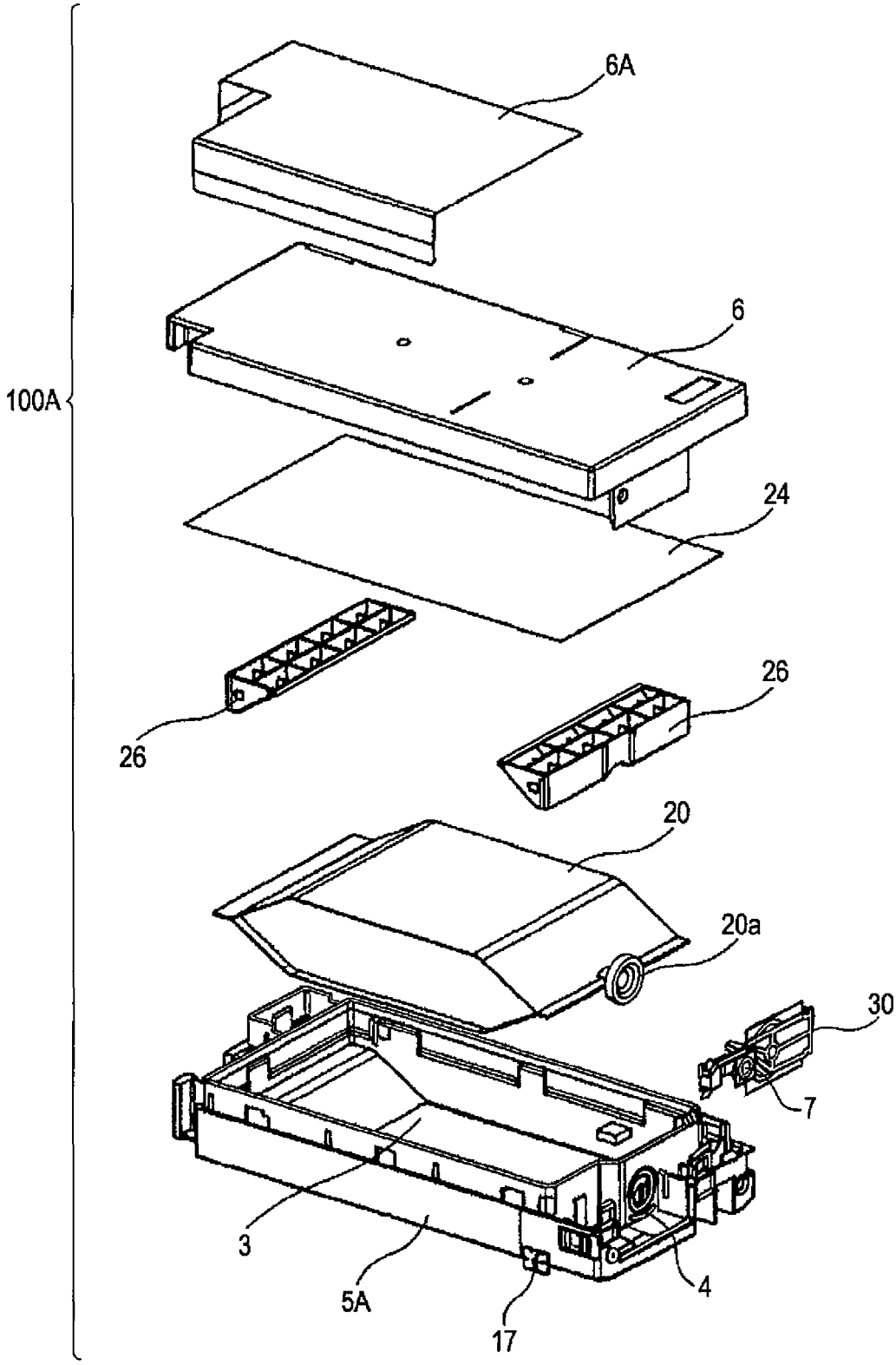
FIG. 12 is an exploded perspective view illustrating the small-capacity ink cartridge as viewed from one side.
Figure 13:
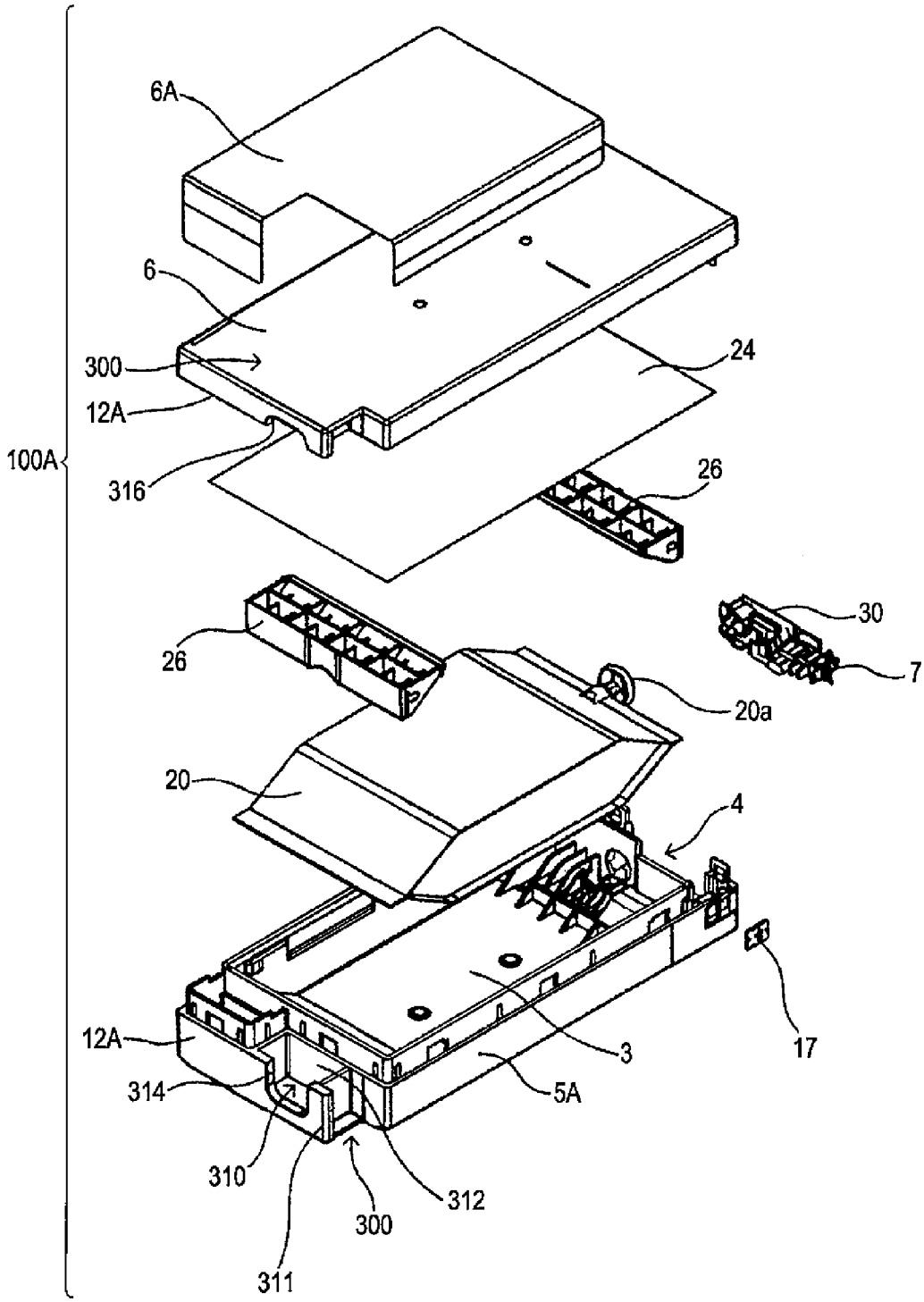
FIG. 13 is an exploded perspective view illustrating the small-capacity ink cartridge as viewed from the other side.
Figure 14:
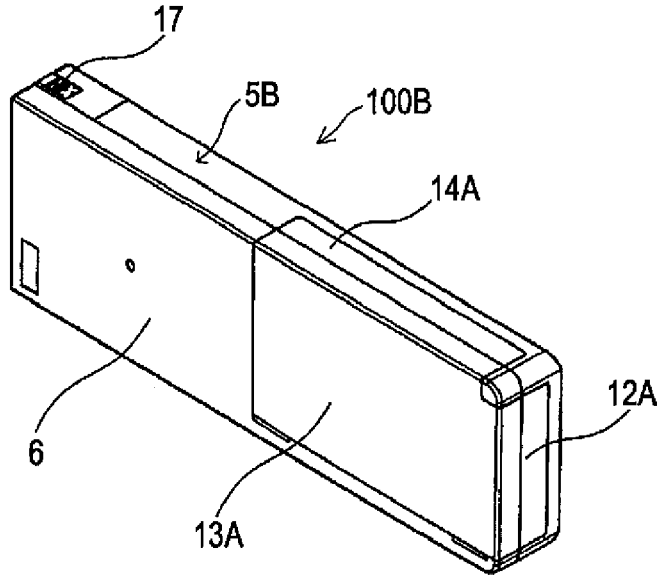
FIG. 14 is a perspective view illustrating a large-capacity ink cartridge as viewed from one side.
Figure 15:
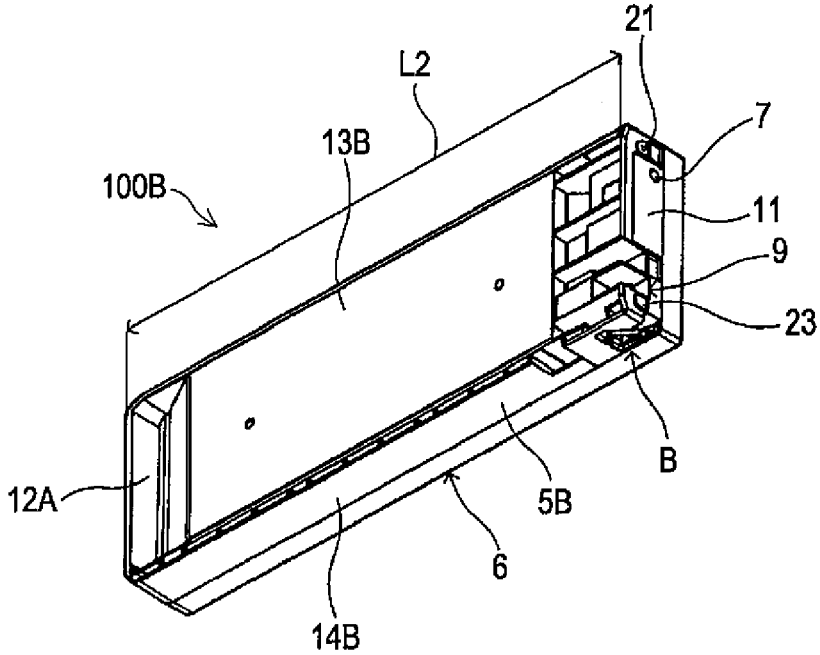
FIG. 15 is a perspective view illustrating the large-capacity ink cartridge shown in FIG. 14 as viewed from the other side.

FIG. 10 is a perspective view illustrating a small-capacity ink cartridge 100A as viewed from one side. FIG. 11 is a perspective view illustrating the small-capacity ink cartridge 100A shown in FIG. 10 as viewed from the other side. FIG. 12 is an exploded perspective view illustrating the small-capacity ink cartridge 100A as viewed from one side. FIG. 13 is an exploded perspective view illustrating the small-capacity ink cartridge 100A as viewed from the other side. FIG. 14 is a perspective view illustrating a large-capacity ink cartridge 100B as viewed from one side. FIG. 15 is a perspective view illustrating the large-capacity ink cartridge 100B shown in FIG. 14 as viewed from the other side.

In FIGS. 10 to 15, the small-capacity ink cartridge 100A and the large-capacity ink cartridge 100B have a common configuration except for existence of the extension section 300, the capacity, and the size. That is, the small-capacity ink cartridge 100A and the large-capacity ink cartridge 100B are different from each other in the size of an outline (capacity of the container) and the size of an ink pack (the capacity of the ink pack and the amount of ink contained in the ink pack). First, the common configuration of the ink cartridges 100 will be described.

As shown in FIGS. 10, 11, 14, and 15, the ink cartridges 100A and 100B have a substantially flat rectangular parallelepiped shape. The outlines include a front face 13A, a back face 13B, a front end face 11, a rear end face 12A, and a pair of side faces 14A and 14B and the areas of the front face 13A and the back face 13B of the six faces are the largest. That is, the front face 13A and the back face 13B are a pair of largest faces. The front end face 11 and the rear end face 12A disposed between the front face 13A and the back face 13B are faces serving as the front end and the rear end in the insertion direction when the ink cartridges 100A and 100B are mounted on the cartridge slots 7A to 7E. The rear end face 12A is opposed to the front end face 11. As shown in FIGS. 11 and 15, the front end faces 11 of the ink cartridges 100 has an ink supply port 7, an air inflow hole 9 (pressurizing fluid introduction hole), a pair of positioning holes 21 and 23. The ink supply port 7 is connected to an ink ejecting hole 20*a* of the ink pack 20 (see FIGS. 12 and 13).

As shown in FIGS. 10, 11, 14, and 15, the ink cartridges 100A and 100B include cases 5A and 5B having a substantially flat rectangular parallelepiped shape and forming a part of the container body, respectively. The common configuration of the cases 5A and 5B will be described using the small-capacity ink cartridge 100A shown in FIGS. 12 and 13.

As shown in FIGS. 12 and 13, a pack accommodating section 3 accommodating the ink pack 20 (liquid containing section) is defined in the cases 5A and 5B. The ink cartridges 100A and 100B include a remaining liquid detection unit 30 and an ink supply port 7 (liquid supply port). The remaining liquid detection unit 30 can be attached to and detached from the case 5. The ink supply port 7 is disposed in the remaining liquid detection unit 30.

The cases 5A and 5B are chassis formed by molding resin and include the pack accommodating sections 3 having sizes that can accommodate the ink packs 20 having different sizes, respectively. The cases 5A and 5B include the pack accommodating section 3 having a substantially box shape of which the top is opened and a detection unit accommodating section 4 located in front of the pack accommodating section 3. The ink pack 20 and resin spacers 26 are accommodated in the pack accommodating section 3. The ink pack 20 is a flexible pack formed of an aluminum-laminated multilayer film in which an aluminum layer is laminated on a resin film layer. The resin spacers 26 are placed on front and rear slopes of the ink pack 20. The remaining liquid detection unit 30 is accommodated in the detection unit accommodating section 4.

The opened surface of the pack accommodating section 3 is sealed with a sheet film 24 after accommodating the ink pack 20 and the resin spacers 26. A pressurizing chamber is defined and formed in the case 5 by the pack accommodating section 3 and the sheet film 24. In the following description, the pack accommodating section 3 is also referred to as a pressurizing space.

When the top surface of the pack accommodating section 3 is covered with the sheet film 24 and the pack accommodating section 3 becomes a sealed chamber, the spacers 26 serve to prevent the ink pack 20 from rattling in the sealed chamber and to fill an empty space in the sealed chamber, thereby enhancing the pressurizing efficiency at the time of pressurizing the inside of the pack accommodating section 3 with the pressurizing air.

A resin cover 6 forming another part of the container body is mounted on the sheet film 24 covering the opened surface of the pack accommodating section 3 and a label 6A is attached thereon.

Different Configuration of Ink Cartridges

In this embodiment, the ink cartridges 100 are based on a lineup including 10 types in total of five colors×two sizes as described above. Ink of five different colors is contained in the ink packs 20 of the ink cartridges of five colors. The five colors of ink cartridges 100 are different from each other, in the kinds of ink contained in the ink packs 20 and the detailed shapes of the identification portions 22 as described above, and are equal to each other in the other configuration. Two types of sizes include the small-capacity ink cartridge 100A and the large-capacity ink cartridge 100B.

The small-capacity ink cartridge 100A is basically different from the large-capacity ink cartridge 100B in the existence of the extension section 300. As can be seen from the comparison of FIG. 11 with FIG. 15, the extension section 300 partitioned from the pressurizing space 3 is disposed at the rear end in the insertion direction of the small-capacity ink cartridge 100A, but the extension section 300 is not disposed in the large-capacity ink cartridge 100B. The extension section 300 is formed by allowing the case 5A and the cover 6 to extend backward, as shown in FIG. 13. The length of the extension section 300 is set to a length enough to restrict the swelling and to help prevent the plastic deformation when the large-capacity ink cartridge 100B is pressurized as described later.

As shown in FIGS. 10 and 11, the small-capacity ink cartridge 100A includes a front end face 11 having a substantially rectangular shape and a rear end face 12A opposed thereto. As shown in FIGS. 14 and 15, the large-capacity ink cartridge 100B also includes a front end face 11 having a substantially rectangular shape and a rear end face 12A opposed thereto. However, the rear end face 12A of the small-capacity ink cartridge 100A is disposed in the extension section 300, but the rear end face 12A of the large-capacity ink cartridge 100B not having the extension section is disposed on an outer wall partitioning the pressurizing space 3. That is, in the small-capacity ink cartridge 100A, the rear end face 12A is located at a position deviated backward by the length of the extension section 300 from the wall 12B partitioning the pressurizing space 3. That is, in the large-capacity ink cartridge 100B, the ink pack 20 and the pressurizing space 3 are disposed in an inner space surrounded with the outline, but in the small-capacity ink cartridge 100A, the ink pack 20, the pressurizing space 3, and the extension section 300 are disposed in the inner space surrounded with the outline. In the small-capacity ink cartridge 100A, the ink pack 20 is disposed in the region close to the front end face 11 in the inner space surrounded with the outline and the extension section 300 is disposed in the region close to the rear end face 12A.

In the large-capacity ink cartridge 100B shown in FIG. 15, the length (the total length) from the front end face 11 of the ink cartridge 100A to the rear end face 12A is a length L2 obtained by adding the thickness of the case to the length for accommodating the ink pack 20. On the other hand, in the small-capacity ink cartridge 100A shown in FIG. 11, the length (the total length) from the front end face 11 of the ink cartridge 100A to the rear end face 12A is greater than a length L1 obtained by adding the thickness of the case to the length for accommodating the ink pack 20. The extension section 300 increases the total length of the ink cartridges 100A to be greater than the necessary length L1. The extension section increases the size of the container body in the longitudinal direction to be greater than the necessary size.

In this embodiment, the extension section 300 of the small-capacity ink cartridge 100A does not form the pressurizing space 3. Of course, the extension section 300 may be made to communicate with the pressurizing space 3. However, in this case, since the pressurizing space is enlarged, it is necessary to introduce more pressurizing fluid into the pressurizing space. Accordingly, the time taken for the pressurizing and the depressurizing is elongated. However, the extension section 300 may be pressurized as described later. That is, the part containing ink (the ink pack 20 in this embodiment) in the inner space of the ink cartridge 100A surrounded with the outline need be partitioned from the outside pressurizing space 3 or the extension section 300. However, it is not essential to partition the pressurizing space 3 and the extension section 300 from each other with the wall 12B or to set the extension section 300 to a non-pressurizing space.

In this embodiment, the liquid containing section is defined by the ink pack 20, but the liquid containing section may be formed without using the ink pack. For example, the inside of the pack accommodating section 3, that is, the space surrounded with the inner wall of the case 5A and the film 24, is partitioned into the liquid containing section and the pressurizing space by the use of a diaphragm, it is possible to form the liquid containing section without using the ink pack.

In this embodiment, as shown in FIGS. 3, 4, 10, and 13, finger hooking portions 310 and 311 are formed in the extension section 300 of the ink cartridge 100A. The finger hooking portion 310 is formed by a hollow portion 312 formed in the extension section 300 shown in FIG. 13, a cut portion 314 formed in the rear end face 12A of the case 5A, and a cut portion 316 formed on the rear end face 12A of the cover 6. By inserting a finger into the hollow portion 312 through the cut portions 314 and 316, the finger can be hooked to the inner wall of the rear end face 12A. The finger hooking portion 311 is formed by a concave portion formed on the side face 14A of the extension section 300, that is, on the side face 14A close to the rear end face 12A of the ink cartridge 100A. The finger hooking portions 310 and 311 are convenient at the time of drawing out the small-capacity ink cartridge 100A from a narrow space located relatively deep in the container holder 200.

Mounting of Ink Cartridge on Holder

As shown in FIG. 4, the ink cartridges 100 are mounted on the cartridge slots 7A to 7E with a vertical posture so that the side face 14A shown in FIGS. 10, 11, 14, and 15 becomes the top surface and the side face 14B becomes the bottom surface. At this time, in the mounting state shown in FIG. 4, the front face 13A and the back face 13B of the large-capacity ink cartridge 100B are opposed to the front face 13A or the back face 13B of the small-capacity ink cartridge 100A.

When the ink cartridges 100 are mounted on the cartridge slots 7A to 7E, the above-mentioned ink supply pins 249 are inserted into the ink supply ports 7. The ink supply pins 249 are connected to the print head 225 through the ink supply passages 223 and the valve units 224.

When the ink cartridges 100 are mounted on the cartridge slots 7A to 7E, the air inflow holes 9 are inserted into the above-mentioned air communication holes 248. The air communication holes 248 are connected to the pressurizing pump 226 through the pressurizing air supply passages 227. The pressurizing pump 226 can supply the pressurizing air to the pack accommodating sections 3 through the pressurizing air supply passages 227, the air communication holes 248, and the air inflow holes 9 to pressurize the ink packs 20. When the ink packs 20 are pressurized in this way, the ink flowing out from the ejection holes 20*a* of the ink packs 20 are supplied to the print head 225 of the ink jet printer 211 through the ink supply ports 7.

As shown in FIGS. 11 and 15, the front end face 11 of the respective ink cartridges 100 has a pair of positioning holes 21 and 23 separated with each other. When the ink cartridges 100 are mounted on the cartridge slots 7A to 7E, the front ends of the positioning pins 247 and 247 are inserted into the positioning holes 21 and 23. Thereafter, when the ink cartridges 100 are further inserted into the deep side of the cartridge slots 7A to 7E, the ink cartridges 100 move relative to the positioning pins 247.

When the ink cartridges 100 are completely mounted on the cartridge slots 7A to 7E, the positioning holes 21 and 23 are fitted to the pairs of positioning pins 247 and 247 to determine the position in the direction along the front end faces 11 of the ink cartridges 100 and thus the movement of the ink cartridges 100 in the direction along the front end faces 11 is restricted. Accordingly, the ink supply ports 7 and the ink supply pins 249 (see FIG. 4) are precisely positioned.

As shown in FIGS. 10 and 14, the circuit board 17 is disposed on the side face 14A of the respective ink cartridges 100. The circuit board 17 is located at a position closer to the front end face 11 than the rear end faces 12A and 12B, particularly, at a position adjacent to the front end face 11. The circuit board 17 is mounted with a memory device not shown for recording information such as the amount of remaining ink or the utilization history of the cartridges.

The remaining liquid detection unit 30 has a remaining amount detection sensor (a sensor employing a piezoelectric element) not shown. The remaining amount detection sensor is a sensor detecting the amount of ink remaining in the ink cartridge. At least one electrode electrically connected to the remaining amount detection sensor is disposed on the circuit board 17.

On the other hand, as shown in FIGS. 6 to 8, the apparatus terminal 250 is disposed above the circuit board 17. The contact of the electrode of the circuit board 17 comes in contact with the contact of the apparatus terminal 250 when the ink cartridges 100 are mounted on the cartridge slots 7A to 7E. Accordingly, the circuit board 17 is electrically connected to the apparatus terminal 250.

When the ink cartridges 100 are mounted on the cartridge holder 200 of the printer 211 (see FIG. 1) and the circuit board 17 is electrically connected to the apparatus terminal 250, the memory device or the remaining amount detection sensor is electrically connected to a control circuit of the printer 211 (see FIG. 1) through the circuit board 17, thereby controlling the operation of the memory device or the remaining amount detection sensor from the printer 211 (see FIG. 1).

Operation of Extension Section

In this embodiment, as shown in FIG. 4, no wall partitioning the ink cartridges 100A and 100B from each other is disposed in the holder 200. The ink cartridges 100A and 100B are mounted on the ink cartridge holder 200 in a state where the front faces and the back faces 13A and 13B adjacent to each other are opposed directly to each other. Accordingly, the lateral width (the size in the direction perpendicular to the front faces and the back faces 13A and 13B of the ink cartridges 100A and 100B) of the container holder 200 decreases by the thickness of the partition wall, thereby causing a decrease in size of the ink jet printer 211.

The function of the extension section 300 disposed in the small-capacity ink cartridge 100A is to enlarge the area of the region (the shape of the front face 13A or the back face 13B in a plan view, which is referred to as "opposed region") where the front face 13A or the back face 13B of the ink cartridge 100A is opposed to the back face 13B or the front face 13A of the ink cartridge 100B adjacent thereto. That is, the area of the opposed region is enlarged by the extension section 300 disposed in the small-capacity ink cartridge 100A.

The extension section 300 is not particularly limited in shape as long as it can enlarge the area of the opposed region Like this embodiment, a part of the rectangular shape may be cut out to expose the wall 12B, as shown in FIGS. 10 and 11. The region opposed to the front face 13A or the back face 13B of the large-capacity ink cartridge 100B is not necessarily a flat plane. In this embodiment, the height (the distance from the front face 13A) of the surface 300A of the extension section 300 is smaller by one step than the height (the distance from the front face 13A) of the flat plane indicated by reference sign 13B1 in FIG. 11 and for example, is smaller by 1 mm. In this way, the extension section 300 is not limited to the structure obtained by extending the surface of the case 5A or the cover 6 in parallel without any change, but the shape (the shape in a plan view or the distance between the front face 13A and the back face 13B) thereof may be changed.

Figure 16:
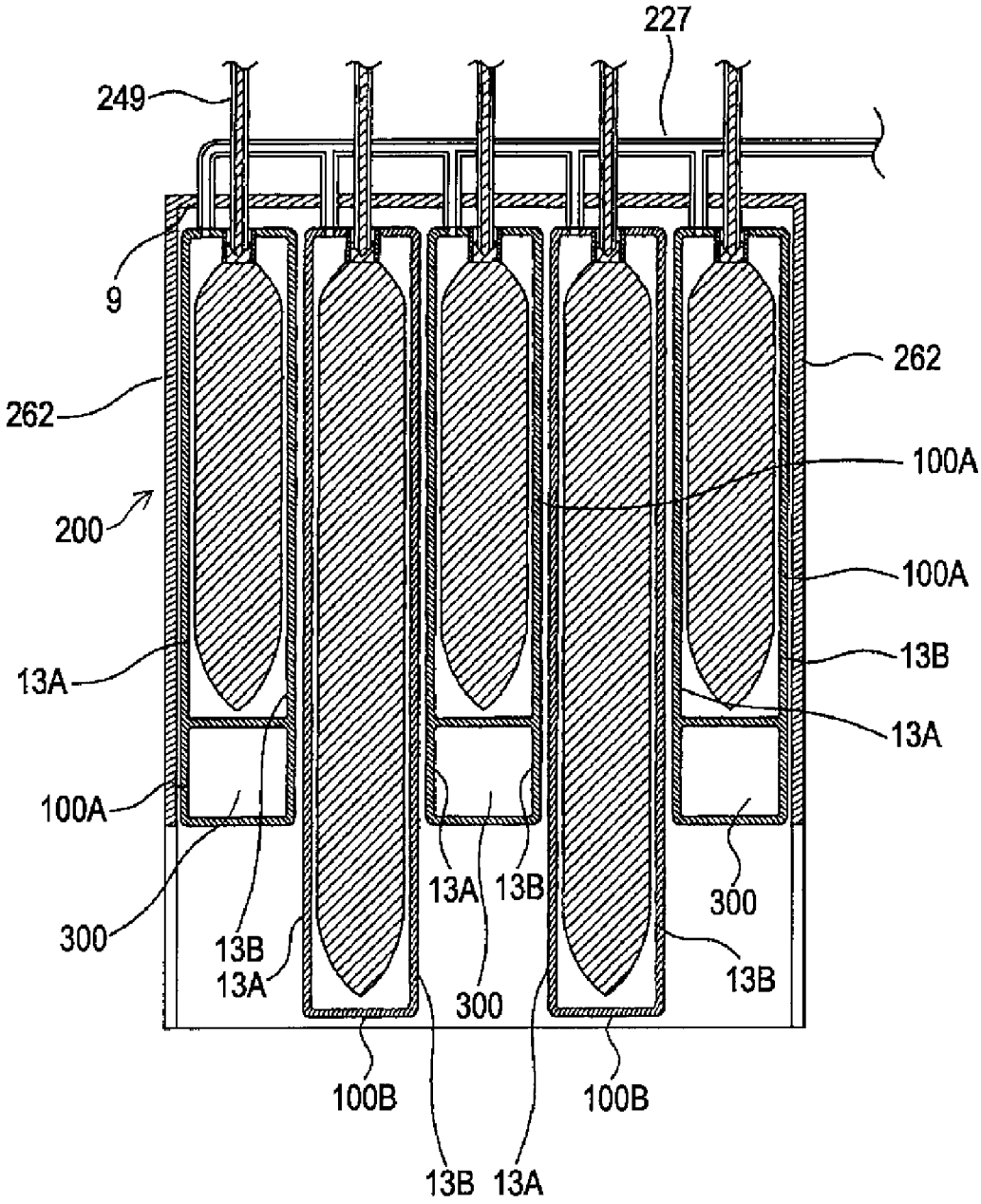
FIG. 16 is a diagram schematically illustrating mounted states (non-pressurized state) of the ink cartridges shown in FIGS. 3 to 5.

FIG. 16 is a diagram schematically illustrating a state (non-pressurized state) where the pressurizing is not performed with the ink cartridges 100A and 100B not mounted on the holder 200 in the same state as shown in FIGS. 3 to 5. A partition wall is not disposed between the neighboring ink cartridges 100A and 100B and the front face and the back faces 13A and 13B of the ink cartridges 100A and 100B are opposed directly to each other with a slight gap therebetween.

Figure 17:
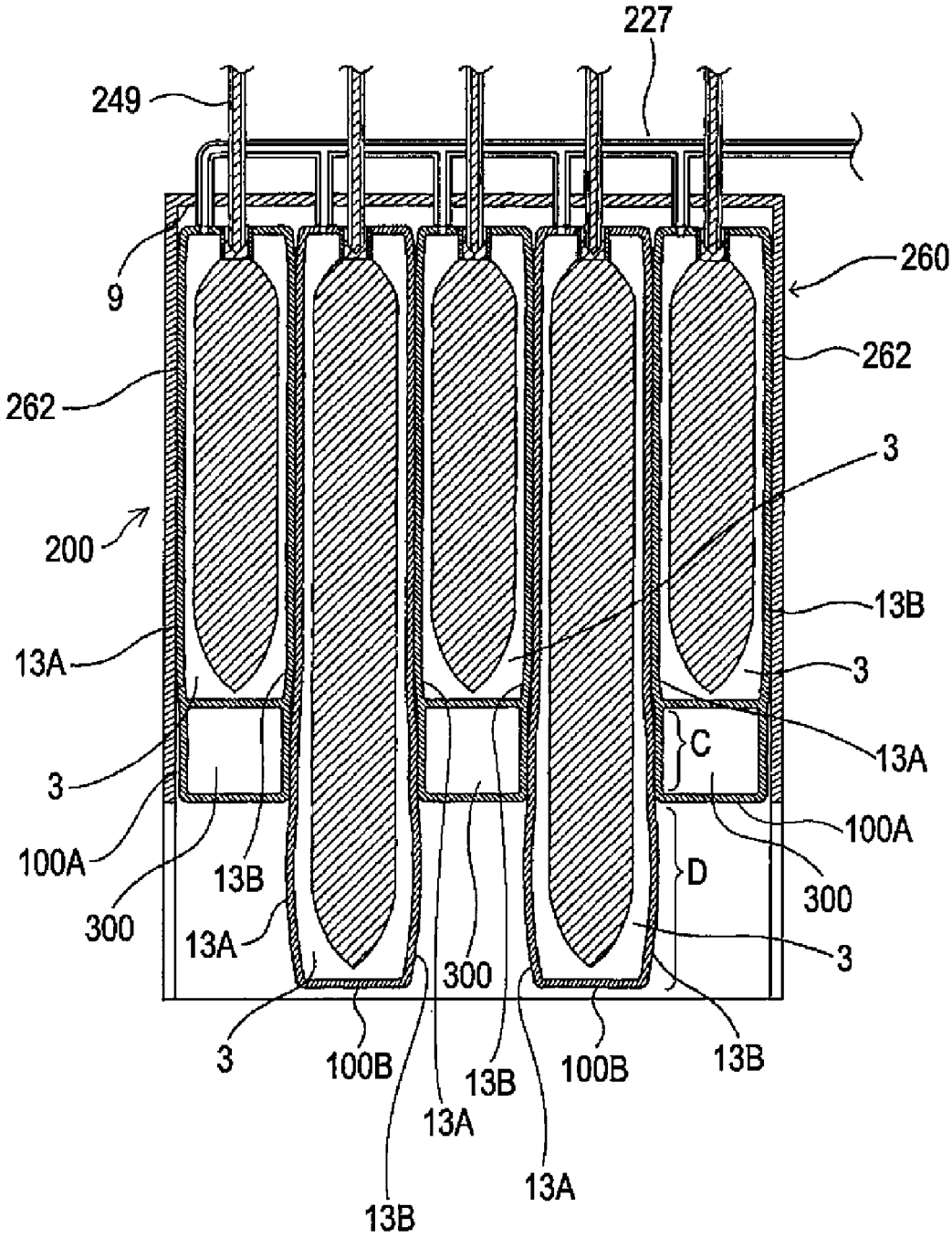
FIG. 17 is a diagram schematically illustrating pressurized states of the ink cartridges shown in FIG. 16.

In this state, in order to supply ink to the ink jet printer 211, the pressurizing air is introduced into the pack accommodating section (pressurizing space) 3 to pressurize the ink pack 20. Then, as shown in FIG. 17, the largest faces (the front face and the back face 13A and 13B) of the ink cartridges 100A and 100B are swelled and deformed. The deformed amount of the largest faces when they are freely swelled without any regulation varies depending on various conditions such as the cartridge size, the materials of the case 5 and the cover 6, and the pressure of the pressurizing air introduced into the pack accommodating section 3. For example, when the pressure of the pressurizing air is 12 to 18 kPa, the largest deformed distance is about 5 to 10 mm.

In this embodiment, when the pressurizing air is introduced into the pack accommodating section (pressurizing space) 3, the largest faces 13A and 13B of the adjacent ink cartridges 100A and 100B are swelled and deformed. In the cartridge slots 7A to 7E without a partition wall, at least a part of the largest faces 13A and 13B of the adjacent ink cartridges 100A and 100B con act with each other and are pressed, thereby restricting the swelling each other. At least a part of the largest faces 13A and 13B, not opposed to the largest faces 13B and 13A of the ink cartridge 100B, of the largest faces 13A and 13B of the both outside ink cartridges 100A contact with the supporting side wall 262 of the frame body 260 opposed thereto and are pressed each other as shown in FIG. 17, thereby similarly restricting the swelling.

That is, as shown in FIG. 7, when the pressurizing fluid is introduced into the ink cartridges 100A and 100B mounted on the cartridge slots 7A to 7E, the cartridges 100A and 100B are strained between a pair of supporting side walls 262 and 262 with the swelling force thereof. The plural ink cartridges 100A and 100B of which the swelling and deformation is restricted are strongly and monolithically fixed to the cartridge slots 7A to 7E.

However, when the small-capacity ink cartridge 100A and the large-capacity ink cartridge 100B are adjacent to each other as in this embodiment, no member restricting the swelling is disposed at the rear end in the insertion direction of the large-capacity ink cartridge 100B having a great total length. Accordingly, when this situation is left, the rear end in the insertion direction of the large-capacity ink cartridge 100B is greatly swelled and may be plastically deformed at worst. As a result, even when the pressurizing is released, the swelled shape is maintained. Then, the non-pressurized shape shown in FIG. 16 is not restored and the swelled large-capacity ink cartridge 100B blocks a part of the demounting route when the small-capacity ink cartridge 100A is demounted.

Therefore, in this embodiment, in order to restrict the large-capacity ink cartridge 100B so as not to be swelled enough to be plastically deformed, means for restricting the swelling of the large-capacity ink cartridge 100B is disposed as the extension section 300 at the rear end in the insertion direction of the small-capacity ink cartridge 100A.

As shown in FIG. 17, thanks to the extension section 300 disposed in the small-capacity ink cartridge 10A, the region where the swelling of the large-capacity ink cartridge 100B is restricted is enlarged by the region C, while the region where the swelling is not restricted is reduced from the region C+D to the region D. Since the region where the swelling is not restricted is reduced, the rigidity of the swelling region D is enhanced. Therefore, compared with the case where the swelling is not restricted in the region C+D, it is possible to reduce or prevent the swelling deformation at the time of the pressurizing when the swelling is not restricted only in the region D, thereby preventing the plastic deformation in the region D. That is, even when the region D of the large-capacity ink cartridge 100B is swelled and deformed due to the pressurizing, the deformed amount can be suppressed within the elastic range. Accordingly, when the pressurizing spaces 3 of the ink cartridges 100A and 100B are depressurized, the swelled ink cartridges 100A and 100B can be restored to the original shapes, that is, the state shown in FIG. 16. When the small-capacity ink cartridge 100A is demounted, it is possible to smoothly demount the swelled ink cartridges 100A and 100B from the holder 200 without allowing the large-capacity ink cartridge 100B to block a part of the demounting route.

When the pressurizing air is introduced into the pressurizing space 3, the faces (the front end face 11, the rear end face 12A, the wall 12B, and the pair of side faces 14A and 14B) other than the front face 13A and the back face 13B as the largest faces may be swelled. However, as the area becomes smaller, the swelled amount becomes smaller. Particularly, in the ink cartridges 100A and 100B according to this embodiment, the area of the pair of side faces 14 and 14B is much smaller than the area of the front face 13 and the back face 13B and the areas of the front end face 11, the rear end face 12A, and the wall 12B are further smaller than that, in a plan view. Accordingly, the swelled amount of the other faces is remarkably smaller than the swelled amount of the front face 13A and the back face 13B and thus the possibility that the faces should be swelled to the plastic deformation is extremely low. Since the pressurized swelling is most remarkable in the pair of largest faces and the pairs of the largest faces of the adjacent ink cartridges 100A and 100B are opposed to each other, it is very important to restrict the pressurized swelling there.

Figure 18:
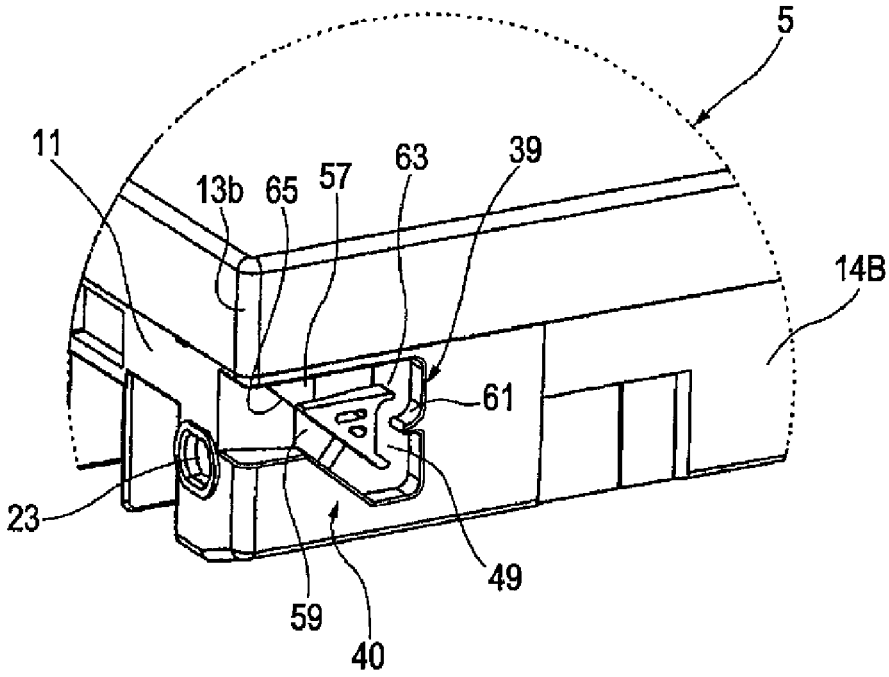
FIG. 18 is an enlarged view illustrating portion B shown in FIGS. 11 and 15.
Figure 19:
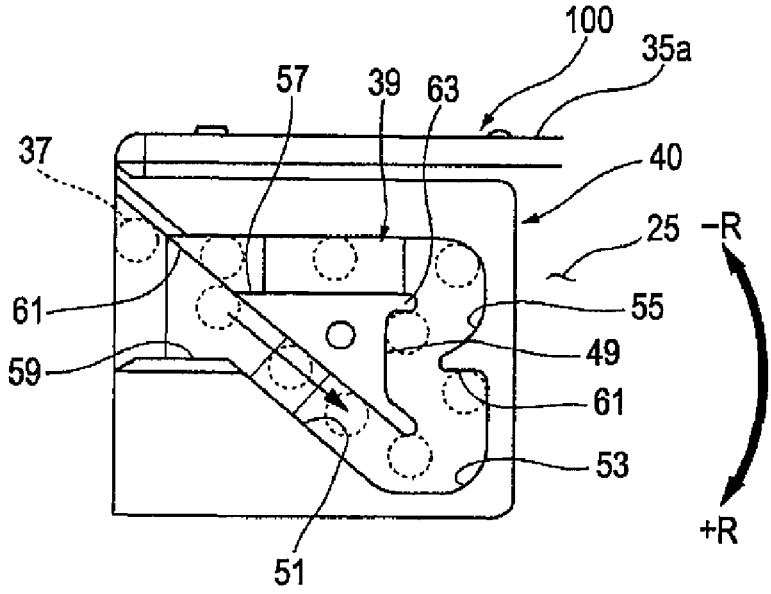
FIG. 19 is an enlarged plan view illustrating a guide groove shown in FIG. 18.

Guarantee of Smooth Mounting and Demounting Operations of Ink Cartridge by Extension Section FIG. 18 is an enlarged view of portion B shown in FIGS. 11 and 14 and FIG. 19 is an enlarged plan view of the guide groove shown in FIG. 18.

As shown in FIGS. 18 and 19, a container fixing structure 40 is provided on the side face 14B. The container fixing structure 40 unlockably regulates the movement in the insertion direction and the opposite direction of the ink cartridge 100 in cooperation with the apparatus fixing structure 50 disposed in the cartridge slots 7A to 7E. The apparatus fixing structure 40 is disposed at a position close to the front end face 11 and particularly at a position adjacent to the front end face 11.

As shown in FIG. 18, the container fixing structure 40 includes a guide groove 39 into which the locking pin 37 of the apparatus fixing structure 50 (see FIG. 9) is inserted and which guides the locking pin 37 as the locking member to a locking position or an unlocking position when the ink cartridges 100 are mounted on and demounted from the cartridge slots 7A to 7E. The container fixing structure 40 also includes a locking portion 49 engaging with the locking pin 37 to regulate the movement in the demounting direction of the ink cartridge 100 in the state where the ink cartridges 100 are mounted on the cartridge slots 7A to 7E.

As shown in FIG. 18, the guide groove 39 includes an entrance guide portion 51, an intermediate guide portion 53, and an exit guide portion 55. The entrance guide portion 51 guides the locking pin 37 when the ink cartridges 100 are inserted into the cartridge slots 7A to 7E. The intermediate guide portion 53 guides the locking pin 37 to the locking portion 49 when the ink cartridges 100 inserted into the cartridge slots 7A to 7E are returned in the demounting direction. The exit guide portion 55 guides the locking pin 37 departing from the locking portion 49 by pushing the ink cartridges 100 in the insertion direction to the exit of the guide groove 39 when the ink cartridges 100 are demounted from the cartridge slots 7A to 7E.

The exit 57 of the guide portion 39 is connected to the entrance 59 and thus the guide groove 39 forms a loop as a whole. In a connecting portion of the entrance 59 and the exit 57, the groove depth of the exit 57 is smaller than the groove depth of the entrance 59 and thus a step 65 is formed in the connecting portion. The step 65 prevents the locking pin 37 from entering the exit 57 when the ink cartridges 100 are inserted into the cartridge slots 7A to 7E.

On the other hand, as shown in FIG. 7, the apparatus fixing structure 50 is disposed below the container fixing structure 40. As described above, the apparatus fixing structure 50 includes the lever member 45 and the spring 44 shown in FIG. 9(*b*).

The lever member 45 is urged in a predetermined rotation direction by the spring 44. This direction is the direction of arrow −R in FIGS. 9(*b*) and 19 and a counterclockwise rotation direction in FIG. 18. When the ink cartridges 100 are mounted on and demounted from the cartridge slots 7A to 7E, the locking pin 37 is inserted into and guided by the guide groove 39 and the lever member 45 rotates in the +R directions along the shape of the guide groove 39.

The operation of the locking pin 37 in the guide groove 39 when the ink cartridges 100 are mounted and demounted will be described now with reference to FIG. 19.

When the ink cartridges 100 are inserted into the cartridge slots 7A to 7E and the ink cartridges 100 are further pushed in the insertion direction against the urging force of the slider member 244 (see FIGS. 6 and 7), the locking pin 37 is inserted into the entrance 59 of the guide groove 39.

The locking pin 37 is urged toward the bottom of the guide groove 39 by the elastic deformation of the lever body 47 (see FIGS. 9(*a*) and 9(*b*)) of the lever member 45 (see FIGS. 9(*a*) and 9(*b*)). When the locking pin 37 goes over the end portion of the entrance guide portion 51, the locking pin moves in the counterclockwise direction in FIG. 19 by the urging force of the spring 44 (see FIGS. 9(*a*) and 9(*b*)).

Then, the locking pin 37 collides with a temporary stopping side wall 61 and stops and a click sound is generated at this time. A user can confirm that the ink cartridge 100 is inserted deep enough by the click sound.

Then, when the user's pushing in the insertion direction is released, the ink cartridge 100 is slightly returned in the demounting direction by the urging force of the slider member 246 (see FIGS. 6 and 7). Accordingly, the locking pin 37 is disengaged from the temporary stopping side wall 61 and the locking pin 37 moves in the counterclockwise direction by the urging force of the spring 44.

The locking pin 37 collides with a final stopping side wall 63 disposed in the locking portion 49 and stops at the locking position and a click sound is generated at this time. The user can confirm that the ink cartridges 100 are fixed to the cartridge slots 7A to 7E (see FIG. 2) by the click sound. Even in the state where the ink cartridges 100 are mounted on the cartridge slots 7A to 7E, the locking pin 37 is urged to the bottom surface of the guide groove 39 by the elastic force of the lever member 47.

As shown in FIG. 16, when this operation of mounting the ink cartridge can be performed with a gap between the ink cartridges 100, no external resistive force hindering the mounting operation is generated. That is, when the plastic deformation of the large-capacity ink cartridge 100B can be prevented by the extension section 300, the click sense at the time of the mounting can be guaranteed as designed.

At the time of demounting the cartridge, by pushing the locked ink cartridge 100, the locking pin 37 is disengaged from the final stopping side wall 63 and the locking pin 37 relatively moves to the non-locking position along the exit guide portion 55 by the urging force of the spring 44 applied to the lever member 45. Then, the cartridge 100 is extruded to the front side by the urging force of the spring 246*c* applied to the slider member 246 (see FIGS. 6 and 7). With the movement of the cartridge 100, the locking pin 37 moves to the exit 57. The locking pin 37 is finally separated from the exit 57, whereby the ink cartridges 100 can be demounted from the cartridge slots 7A to 7E.

As shown in FIG. 16 when the operation of demounting the ink cartridge can be performed with a gap between the ink cartridges 100, no external resistive force hindering the demounting operation is generated. That is, when the plastic deformation of the large-capacity ink cartridge 1003 can be prevented by the extension section 300, the demounting of the ink cartridges 100 using the urging force of the spring 246*c* can be guaranteed as designed.

It is preferable that operations of the mounting and demounting the ink cartridges 100 can be performed with a force of 5 kgf or less. Thanks to the operation of the extension section 300 in this embodiment, the operations of mounting and demounting the ink cartridges 100 can be guaranteed with the force of 5 kgf or less, even in the closely mounted state shown in FIGS. 3 to 5 or FIGS. 16 and 17.

Although the invention has been described above in detail with reference to the embodiment, it will be easily understood by those skilled in the art that the invention can be modified in various forms without substantially departing from the novel subject matter and advantages of the invention. Accordingly, such modified examples are included in the scope of the invention. For example, a term described at least once along with a wider term or equivalent different term in the specification or the drawings may be replaced with the different term at any place of the specification or the drawings.

For example, a hollow portion may be formed in the extension section 300 and the hollow portion may be made to communicate with the pressurizing space 3. That is, unlike the above-mentioned embodiments, the extension section 300 may be actively pressurized and deformed. In this case, since the extension section 300 is swelled toward one of the pair of largest faces 13A and 13B of the large-capacity ink cartridge 100B, it is possible to enhance the deformation restricting effect.

The application of the liquid container according to the invention is not limited to the ink cartridge of the ink jet printer. The invention can be applied to a variety of liquid consuming apparatuses having a liquid ejecting head ejecting minute liquid droplets and the like.

Specific examples of the liquid consuming apparatus include an apparatus having a coloring material ejecting head used to manufacture a color filter of a liquid crystal display and the like, an apparatus having an electrode material (conductive paste) ejecting head used to form electrodes of an organic EL display, a field emission display (FED), and the like, an apparatus having a biological organic material ejecting head used to manufacture a bio chip, an apparatus having a sample ejecting head as a precise pipette, a cloth printing machine, and a micro dispenser.

In the invention, the liquid is not particularly limited as long as it can be ejected from a liquid consuming apparatus. A representative example of the liquid is ink described in the above-mentioned embodiments. The liquid may be a material such as liquid crystal other than the material used to print characters or images. In the invention, the liquid may be a material in which solid materials such as pigments or metal particles may be mixed into a liquid as one phase of a material, in addition to the liquid as one phase of a material.

The invention claimed is:

1. A liquid container adapted to be mounted on a container holder of a liquid consuming apparatus in a state in which largest faces of neighboring liquid containers, each having a substantially rectangular parallelepiped shape, are adjacent to each other, and adapted to supply a liquid with an introduction of a pressurizing fluid from the liquid consuming apparatus, the liquid container comprising:

an outline including:

a pair of largest faces;

a pair of side faces disposed between the pair of largest faces;

a front end face being disposed between the pair of largest faces and having a liquid supply port and a pressurizing fluid introduction hole; and a rear end face opposed to the front end face, an inner space surrounded by the outline including a liquid containing section containing a liquid, a pressurizing space into which a pressurizing fluid is introduced, and an extension section partitioned from the liquid containing section, wherein the liquid containing section is disposed in an area of the inner space closer to the front end face, and the extension section is disposed in an area of the inner space closer to the rear end face, wherein the liquid container is a small-capacity liquid container of a plurality of liquid containers selected from a container lineup including at least a large-capacity liquid container and the small-capacity liquid container having an entire length smaller than that of the large-capacity liquid container.

2. The liquid container according to claim 1, wherein a wall is provided in the inner space, the wall partitioning the extension section from the pressurizing space.

3. The liquid container according to claim 2, wherein the extension section is a non-pressurizing space into which the pressurizing fluid is not introduced.

4. The liquid container according to claim 1, wherein the pressurizing fluid is introduced into the extension section.

5. The liquid container according to claim 1, wherein a finger hooking portion to which a finger is hooked when the liquid container is demounted from the container holder is formed in the rear end face of the outline.

6. The liquid container according to claim 1, wherein the outline includes a guide groove guiding a lever member disposed in the container holder to an entrance, an exit, and a locking portion, wherein the guide groove includes:

an entrance guide portion guiding the lever member disposed in the container holder from the entrance to an entrance route when the liquid container moves forward and is mounted on the container holder;

an intermediate guide portion guiding the lever member passing through the entrance guide portion to a locking position when the liquid container is pushed and returned with an urging force of a slider member urging the liquid container in a direction opposite to the mounting direction; and an exit guide portion guiding the lever member to an exit route to demount the liquid container with the urging force of the slider member when the liquid container is made to move forward against the urging force of the slider member when the liquid container is demounted from the container holder.

7. The liquid container according to claim 1, wherein the outline includes a circuit board electrically connected to a terminal disposed in the container holder.

8. The liquid container according to claim 1, further comprising:

a liquid detector connected to the liquid containing section to detect whether an amount of remaining liquid supplied from the liquid containing section is less or greater than a predetermined value; and a contact terminal electrically connected to a terminal disposed in the container holder.

* * * * *